US006712450B2

(12) United States Patent
Nou

(10) Patent No.: US 6,712,450 B2
(45) Date of Patent: Mar. 30, 2004

(54) INK JET PRINTER

(75) Inventor: Hiroshi Nou, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/150,503

(22) Filed: May 20, 2002

(65) Prior Publication Data

US 2002/0180815 A1 Dec. 5, 2002

Related U.S. Application Data

(63) Continuation of application No. PCT/JP99/06512, filed on Nov. 22, 1999.

(51) Int. Cl.[7] ..... B41J 2/21
(52) U.S. Cl. ..... 347/43; 347/15; 347/10
(58) Field of Search ..... 347/43, 15, 16, 347/19, 10, 11, 14, 57

(56) References Cited

U.S. PATENT DOCUMENTS

| | | | | | |
|---|---|---|---|---|---|
| 4,746,935 | A | * | 5/1988 | Allen | 347/98 |
| 5,798,776 | A | * | 8/1998 | Uchiyama et al. | 347/43 |
| 6,270,180 | B1 | * | 8/2001 | Arakawa et al. | 347/14 |
| 6,533,393 | B1 | * | 3/2003 | Meyer et al. | 347/43 |

FOREIGN PATENT DOCUMENTS

| | | |
|---|---|---|
| EP | 0 730 246 A1 | 9/1996 |
| EP | 0 730 971 A2 | 9/1996 |
| EP | 0 730 971 A3 | 8/1997 |
| JP | 61-104856 | 5/1986 |
| JP | 7-40549 | 2/1995 |
| JP | 10-114060 | 5/1998 |
| JP | 10-129011 | 5/1998 |
| JP | 10-151769 | 6/1998 |
| JP | 10-329313 | 12/1998 |

* cited by examiner

*Primary Examiner*—Lamson Nguyen
(74) *Attorney, Agent, or Firm*—Armstrong, Kratz, Quintos, Hanson & Brooks, LLP

(57) ABSTRACT

An ink jet printer comprises a color head having a plurality of nozzles arranged on a head carrier, each of the plurality of nozzles injecting color ink particles by the drive of a piezoelectric element; and a monochrome head having a plurality of nozzles arranged the head carrier, each of the plurality of nozzles injecting monochrome ink particles by the drive of a piezoelectric element. Within a single scanning of the head carrier, a control unit switches the printing mode between a color printing mode by the color head and a monochrome printing mode by the monochrome head, to thereby provide a control of printing. For the color-printing mode, a multivalued intensity mode is set, and for the monochrome-printing mode, a high-resolution mode is set, where the resolution of the monochrome head is integer times the resolution of the color head.

21 Claims, 22 Drawing Sheets

T3

Vwc1

Vwc2

Vwc3

Vwk1

Vwk2

Vwk3

COLOR DATA
(Y,M,C)

MONOCHROME
DATA(K1,K2)

CLOCK

LATCH

FIG. 16

| DOT DATA | | DRIVE WAVEFORM TO BE SELECTED | |
|---|---|---|---|
| b1 | b2 | Y, M, C | K1, K2 |
| 0 | 0 | NONE | NONE |
| 0 | 1 | Vwc1 | Vwk1 |
| 1 | 0 | Vwc2 | Vwk2 |
| 1 | 1 | Vwc3 | Vwk3 |

INK JET PRINTER

This application is a continuation of international application PCT/JP99/06512 filed on Nov. 22, 1999.

TECHNICAL FIELD

The present invention relates generally to an ink jet printer having a color head and a monochrome head, and more particularly to an ink jet printer that is switchable, during a single scanning operation, between a color printing mode by the color head and a monochrome printing mode by the monochrome head.

BACKGROUND ART

Up until now, a print head of an ink jet type includes a nozzle, a pressure chamber, an ink supply system, an ink tank and a piezoelectric element, and records characters or images on a recording medium, like paper, etc., allowing ink particles to be injected from the nozzle, after transmitting the displacement and pressure generated at the piezoelectric element to the pressure chamber.

FIG. 1 is a block diagram of the conventional ink jet printer. The ink jet printer comprises a control unit 200 and a head carrier 202. To the control unit 200, a CPU 206 to control the whole, a memory 208, an interface 210 to connect to a host 204, a controller 212, an image memory 214, a mechanical driver 216 to drive a mechanism 218, and a drive waveform generation unit 220 are installed. To the head carrier 202, a color head drive unit 222, a monochrome head drive unit 224, a color head 226, and a monochrome head 228 are mounted. The monochrome or color image data sent from the host computer 204 to the control unit 200 is processed by the CPU 206 and written into the image memory 214. Of these image data, the color image data is split into color components, Y, M and C, and written into the image memory 214. When printing documents, etc. in the monochrome mode, the controller 212 sequentially reads monochrome data (K) from the image memory 214, corresponding to the nozzle layout of the head, and supplies the data to the monochrome head drive unit 222. As drive waveform data is already written in a waveform memory located in the controller 212 as monochrome drive waveform data, and the drive waveform data is continuously outputted to the drive waveform generation unit 220, and supplied to the monochrome head drive unit 224, after being converted into analog drive waveform. The monochrome data from the controller 212 is used to select drive waveform at the monochrome head drive unit 224, and the selected drive waveform is supplied to the monochrome head 228, so that the printer records characters or images on a record medium like the paper, etc., as the piezoelectric element drives ink particles to be injected from the nozzle.

Also, when printing color images, like photos or graphics, the conventional ink jet printer supplies a group of drive waveforms consisting of a plurality of drive waveforms corresponding to the number of intensities from the drive waveform generation unit 220 to the color head drive unit, based on the color waveform data written in a waveform memory of the controller, and further supplies them to the color head 26, after selecting waveform of intensities corresponding to the individual color data of Y, M, and C, to print multi-intensity color image. On the other hand, when printing binary images, like monochrome characters or line-drawings, the conventional printer supplies a group of drive waveforms with improved degree of resolution to obtain sharp image, in short, it supplies drive waveforms having higher frequency than in the case of color images, so as to upgrade resolution.

However, in the ink jet printer, in which the monochrome printing and the color printing share the use of the conventional drive waveform generation unit 220, if the printer must print the document 230 as shown in FIG. 2, in which the color photo 232 is inserted in the monochrome text 234, the printer cannot print the monochrome text 234 and the color photo 232 simultaneously, by performing only a single head scanning. Therefore, the printer traditionally prints the monochrome text 234 while the monochrome head 28 is scanning once, as setting high resolution for monochrome scanning, and then, it prints the remaining color photo 234 with the color head 226, in the same scanning position, after shifting to multi-intensity color scanning. Because of this, if monochrome text and color photo is intermingled while the head is scanning one stroke, the printer must divide scanning into two modes, multi-intensity color scanning and high-resolution monochrome scanning modes, thereby resulting in a problem that the printing speed can be reduced by half.

DISCLOSURE OF THE INVENTION

According to the ink jet printer of the present invention there is provided an ink jet printer that can print by a single scanning operation, even if monochrome images and color images are intermingled, to speed up the printing speed.

The present invention is directed to an ink jet printer comprising a color head having a plurality of nozzles arranged on a head carrier, each of the plurality of nozzles injecting color ink particles by the drive of a piezoelectric element; and a monochrome head having a plurality of nozzles arranged the head carrier, each of the plurality of nozzles injecting monochrome ink particles by the drive of a piezoelectric element; wherein the ink jet printer comprises a control unit which, within a single scanning of the head carrier, switches the printing mode between a color printing mode by the color head and a monochrome printing mode by the monochrome head, to thereby provide a control of printing. As described above, the ink jet printer in accordance with the present invention will be able to make simultaneous printing with high speed, switching between color image and monochrome image within a single scanning of the head carrier.

The control unit of the ink jet printer includes a color drive waveform generation unit which simultaneously generates a group of color drive waveforms representative of at least two types of color dots; a monochrome drive waveform generation unit which simultaneously generates a group of monochrome drive waveforms representative of at least two types of monochrome dots; a color data output unit which outputs color data for a single scanning from a color image, in synchronism with a single scanning of the head carrier; a monochrome data output unit which outputs monochrome data for a single scanning from a monochrome image, in synchronism with a single scanning of the head carrier; a color head drive unit which selects one waveform from the group of color drive waveforms, based on the color data, the color head drive unit supplying the selected one waveform to the piezoelectric element of the color head for the drive thereof; and a monochrome head drive unit which selects one waveform from the group of monochrome drive waveforms, based on the monochrome data, the monochrome head drive unit supplying the selected one waveform to the piezoelectric element of the monochrome head for the drive thereof. By virtue of this configuration of the control unit, in cases where color data and monochrome data are intermingled in the printing data for a single scanning of the head carrier, the control unit can select the color head drive waveform in response to the color data during the single scanning, and select the monochrome waveform drive signal in response to the monochrome data, to thereby provide a switching between the color printing mode and the monochrome printing mode. The color printing mode of the control unit is a multivalued intensity mode, and the monochrome printing mode of the control unit is a high-resolution mode in which the resolution of the monochrome head is integer times the resolution of the color head. As described above, the printer can ensure high quality image printing, as well as high-speed printing, as a result of setting the color printing mode to multivalued intensity mode, and the monochrome printing mode to high-resolution mode, even if color image including a full-color picture, etc., and monochrome image including line-drawing, etc. are intermingled. In the multivalued intensity mode of the control unit, the amount of ink particles of the color head is variable for each nozzle. The high resolution mode of the control unit can employ any one form of the followings for example.

(1) the resolution in the horizontal scanning direction of the monochrome head is integer times the resolution of the color head;
(2) the ink injection cycle of the monochrome head is integer times the ink injection cycle of the color head;
(3) a multiple of the ink injection cycle of the monochrome head relative to the ink injection cycle of the color head is equal to a multiple of the resolution in the vertical scanning direction of the monochrome head relative to the resolution in the vertical scanning direction of the color head;
(4) the resolution in the vertical scanning direction of the monochrome head is integer times the resolution in the vertical scanning direction of the color head;
(5) the number of nozzle lines of the monochrome head is integer times the number of nozzles lines for each color of the color head; and
(6) a multiple of the number of nozzle lines of the monochrome head relative to the number of nozzle lines for each color of the color head is equal to a multiple of the resolution of the monochrome head relative to the resolution of the color head in the horizontal scanning direction.

A basic drive frequency of a group of color drive waveforms generated by the color drive waveform generation unit is equal to a basic drive frequency of a group of monochrome drive waveforms generated by the monochrome drive waveform generation unit. In this case, at least one intensity waveform of the group of the monochrome drive waveforms is a drive waveform that allows ink particles to be injected twice or more during a single injection cycle of the group of the color drive waveforms. The color data supplied to the color head drive unit, and the monochrome data supplied to the monochrome head drive unit are a set of pixel data containing a plurality of bits, and the bit data of color pixels contains information representing ink particle diameters by the color drive waveform, while the bit data of monochrome pixels contains information representing dot positions by the monochrome drive waveform. The color head drive unit and the monochrome head drive unit include for each piezoelectric element an analog multiplexer of multi-input/single output which inputs a plurality of drive waveforms and selects any one waveform or does not perform selection at all, depending on the pixel data bit. The color drive waveform generation unit generates at least two types of color drive waveforms for different ink particle diameters, and the monochrome drive waveform generation unit generates at least two types of monochrome drive waveforms that can drive injection once or a plurality of times within a single monochrome cycle. For instance, the color drive waveform generation unit generates color drive waveforms for different ink particle diameters, such as large, medium, and small diameters. The monochrome drive waveform generation unit generates monochrome drive waveforms for all dot patterns with different positions, such as front, rear, and both front and rear positions. Common head control signals, including clock, shift, etc., are supplied both to the color head drive unit and the monochrome head drive unit. The color head drive unit and the monochrome head drive unit are mounted on the head carrier. The color drive waveform generation unit and the monochrome drive waveform generation unit include a waveform memory storing the group of drive waveform data, and an AD conversion unit which converts the group of drive waveform data simultaneously read out of the waveform memory, into analog waveforms.

BRIEF DESCRIPTION OF DRAWINGS

FIG. 16 illustrates a logic chart of drive waveform selection by 2-bit pixel data;

BEST MODE FOR CARRYING OUT THE INVENTION

Figure 3:
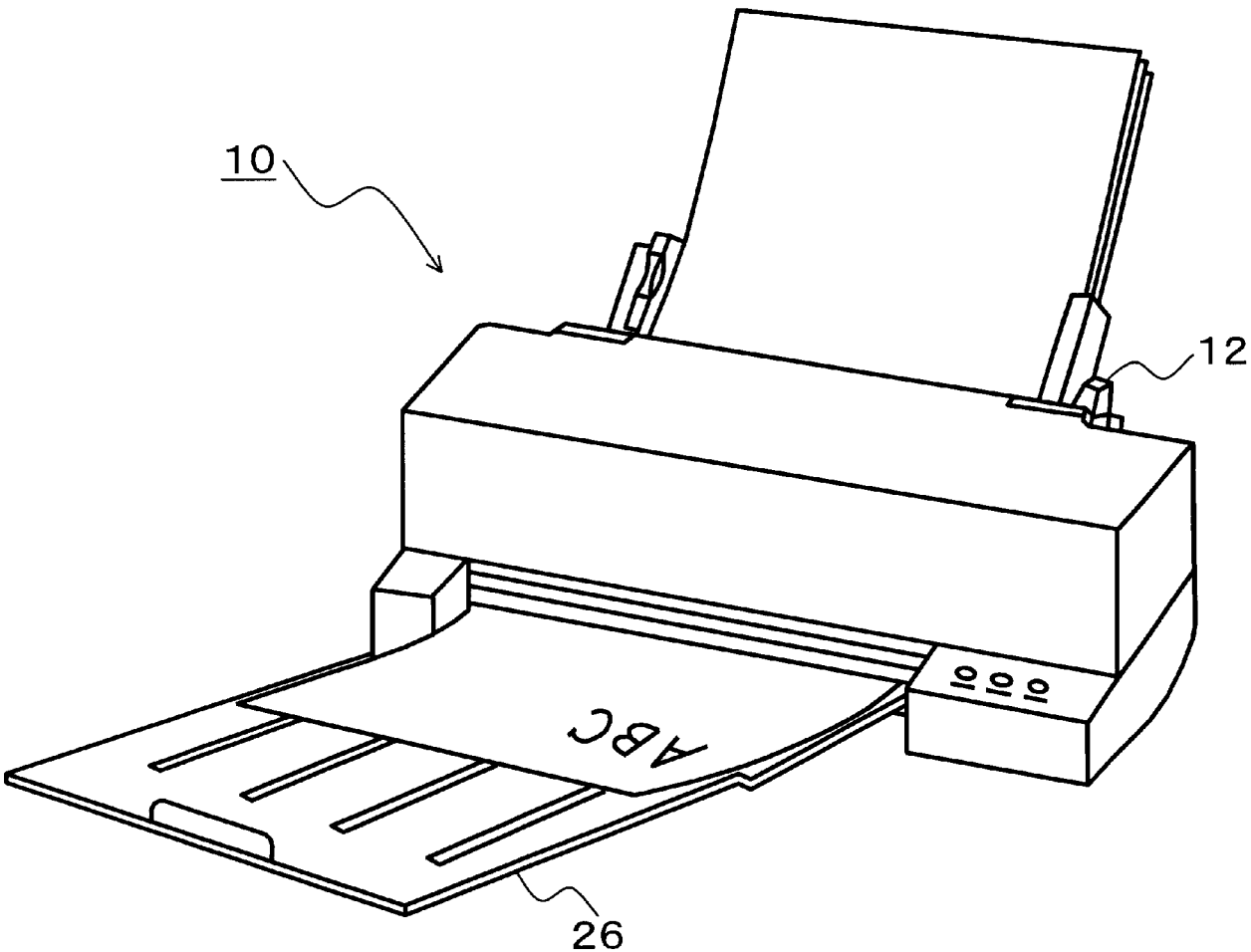
FIG. 3 illustrates the appearance of the ink jet printer in accordance with the present invention.

FIG. 3 shows an ink jet printer in accordance with the present invention. In FIG. 3, the ink jet printer 10 has a paper insertion guide 12 and a paper ejection guide 26. The paper insertion guide 12 is a guide to insert the not-printed paper into the printer. The paper ejection guide 26 holds the ejected paper.

Figure 4:
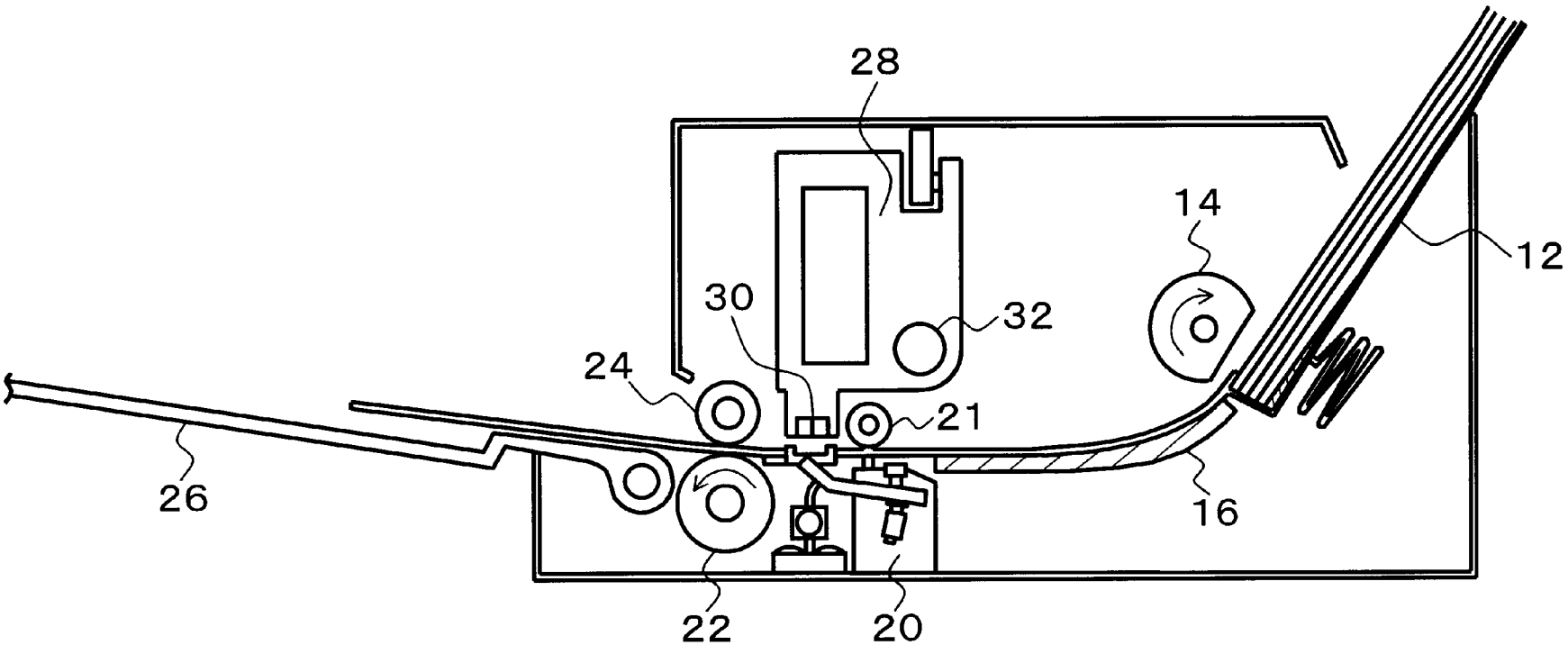
FIG. 4 illustrates the internal structure of FIG. 3.

FIG. 4 shows the internal structure of the ink jet printer 10 shown in FIG. 3. The paper held by the paper insertion guide 12 is picked up by a pick-up roller 14, and guided by a sheet guide 16. A sheet push roller 21 in front of a head 28 pushes the paper fed by the sheet guide 16. The paper printed by the head 28 is fed toward the rear by a feed roller 22, and at this time, the paper gets caught between a sheet push roller 24 and the feed roller 22. The ink jet head 28 is installed with its nozzle face 30 facing down. Also, the ink jet head 28 travels along a shaft 32 that can be extended in the direction of depth as viewed from the illustration. A cleaning mechanism 20 cleans the nozzle face 30 of the ink jet head 28. The cleaning mechanism 20 is installed to the outside of the ink jet head 28 and to the underside of the nozzle face 30 of the ink jet head 28.

Figure 5A:
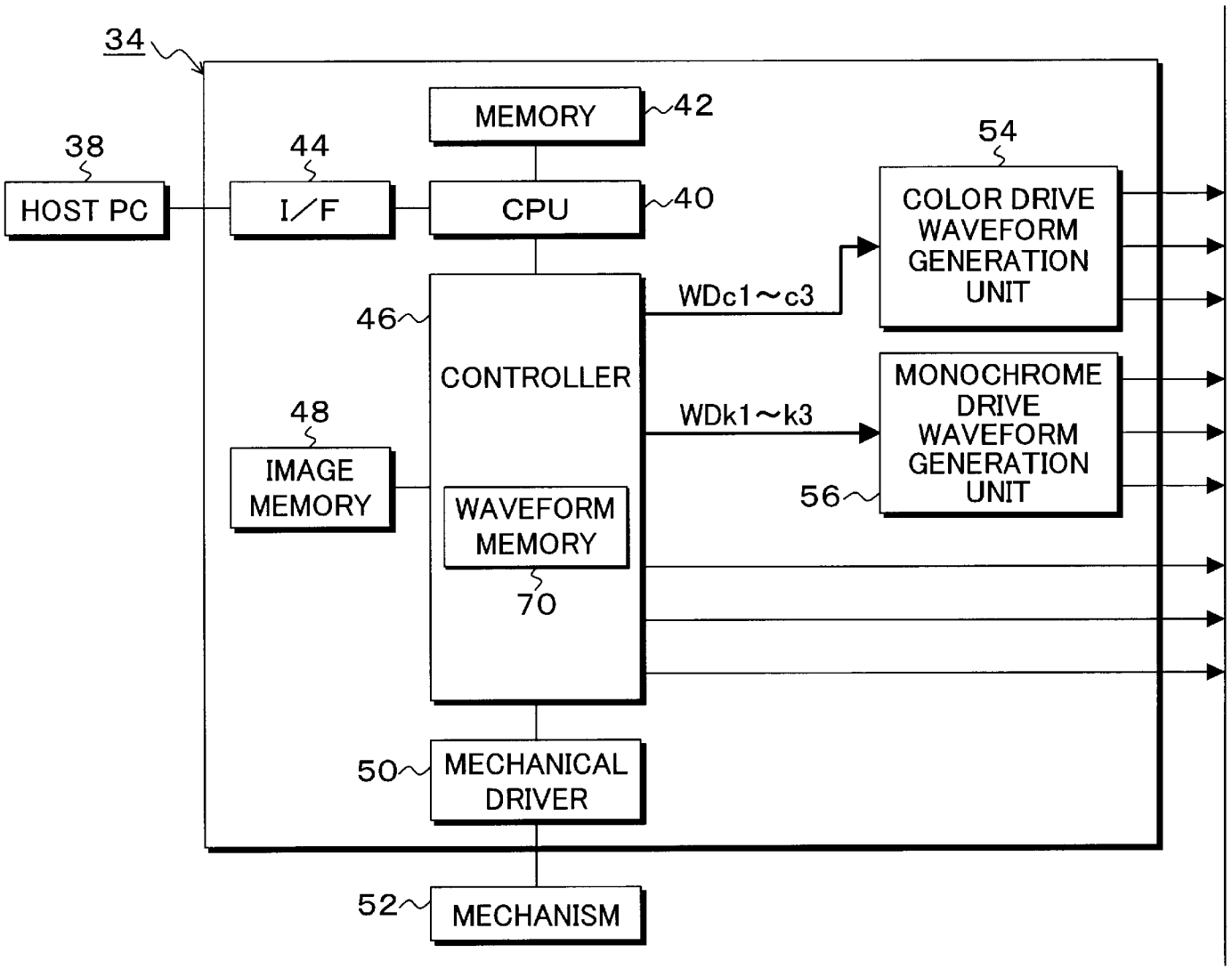
FIGS. 5A and 5B are block diagrams of the ink jet printer in accordance with the present invention.
Figure 5B:
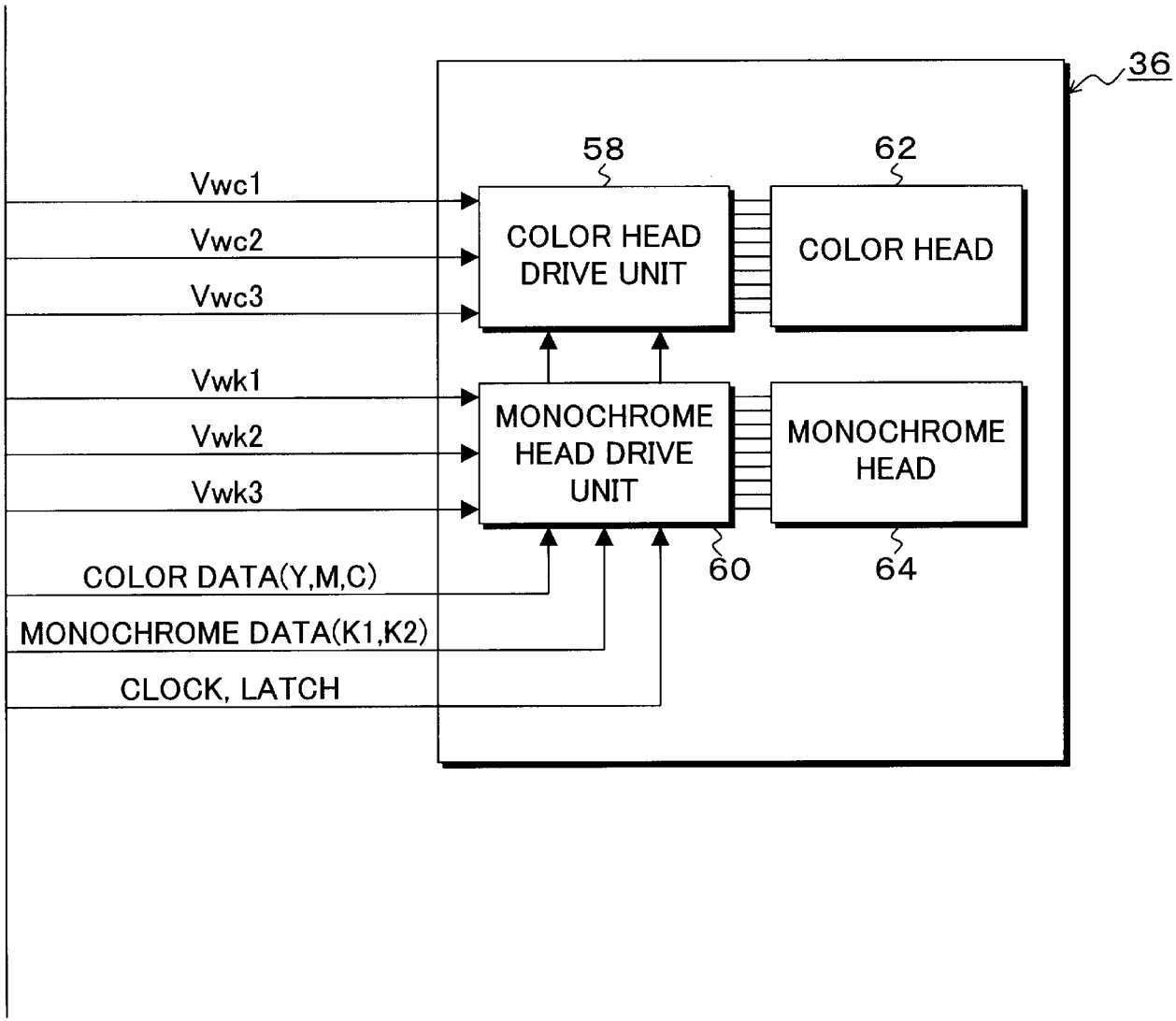

FIGS. 5A and 5B are block diagrams showing functions of a control unit and a head carrier of the ink jet printer in accordance with the present invention. The ink jet printer in accordance with the present invention comprises a control unit 34 and a head carrier 36. To the control unit 34, a CPU 40 to control the whole of the printing movement, a memory 42, an interface 44 to connect a host computer 38, a controller 46 to be installed as a control logic, an image memory 48, a mechanical driver 50 to drive a mechanism 52 including the structure shown in FIG. 4, and further a color drive waveform generation unit 54 to generate a color drive waveform signal to be supplied to a color head, and a monochrome drive waveform generation unit 56 to generate a monochrome drive waveform signal to be supplied to a monochrome head are installed. Also, to the head carrier 36, a color head drive unit 58, a monochrome drive unit 60, a color head 62 and a monochrome head 64 are mounted.

Figure 6:
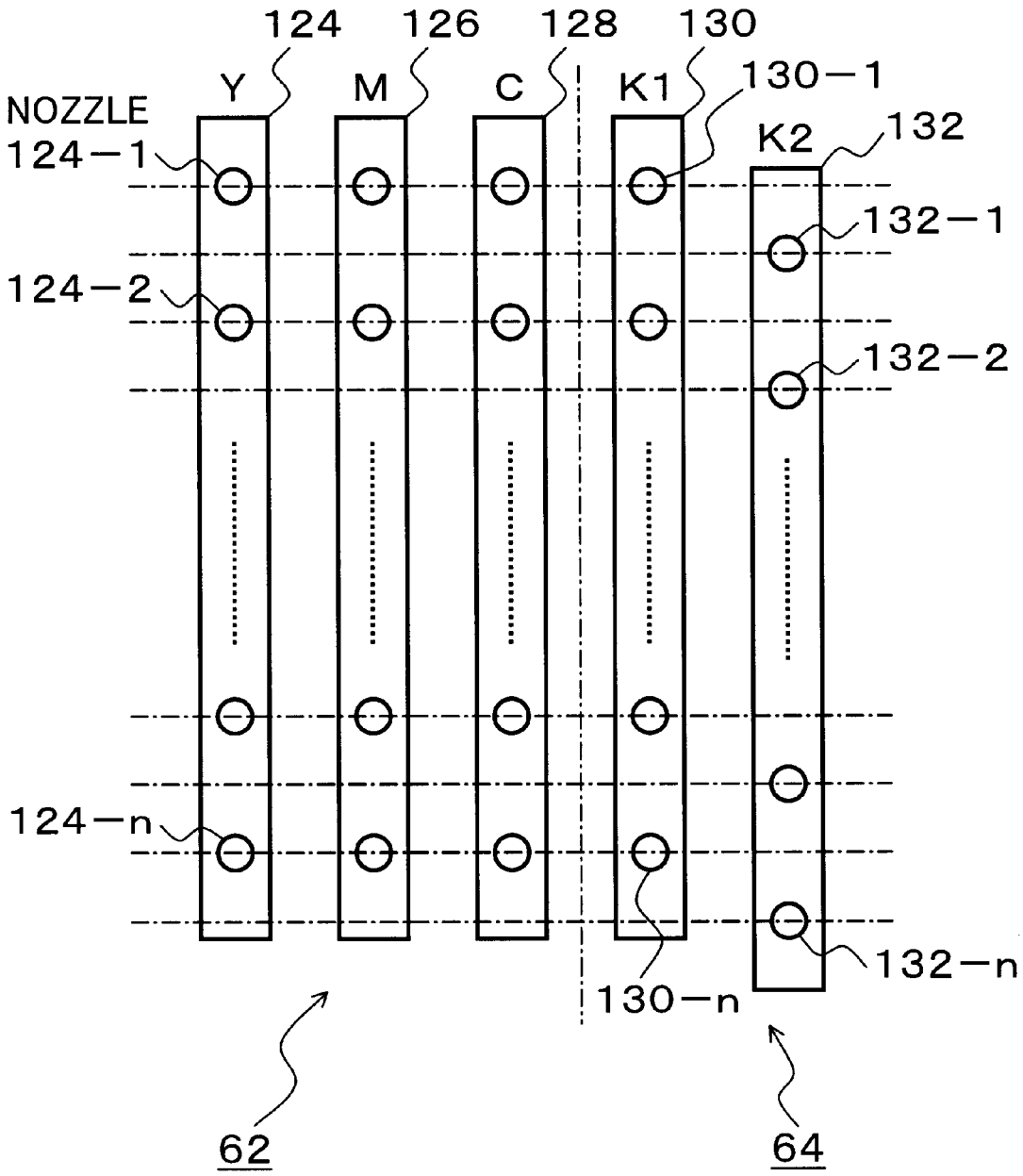
FIG. 6 illustrates the nozzle layouts of a color head and a monochrome head shown in FIGS. 5A and 5B.
Figure 7:
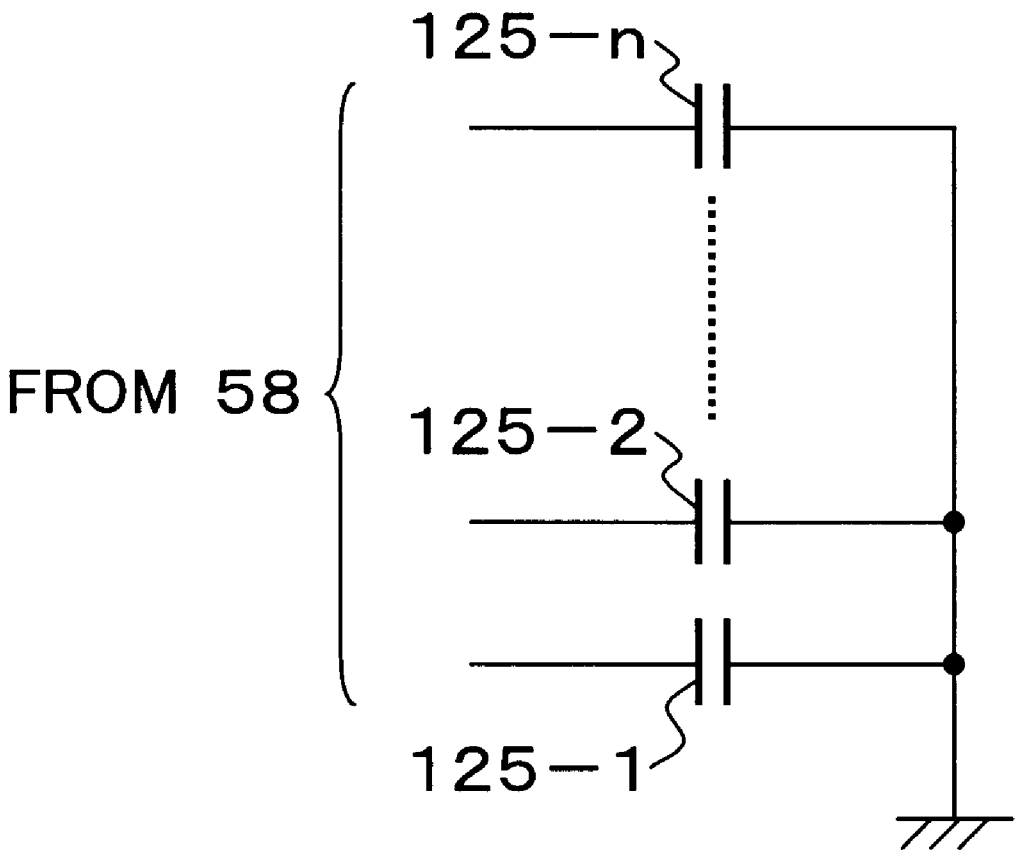
FIG. 7 illustrates a head piezoelectric element shown in FIGS. 5A and 5B.

FIG. 6 illustrates nozzle layouts of the color head 62 and the monochrome head 64 installed to the head carrier 36, shown in FIGS. 5A and 5B. This embodiment takes the case as an example, where the color head 62 performs printing of 4 intensities with 300 dpi, and the monochrome head 64 performs monochrome printing of 2 intensities with 600 dpi, that is double the resolution of the color head 62. As the color head 62 shown in FIG. 6 performs color printing using a compound consisting of the color elements Y, M and C, a Y head 124, an M head 126 and a C head 128 are installed. To the individual heads 124, 126 and 128 for these Y, M, C, n pieces of nozzles are placed in a vertical scanning direction, in short, a vertical direction as illustrated. For instance, as shown in the case of the Y head, nozzles 124-1, 124-2, . . . 124-n are placed. As the resolution of the monochrome head 64 is double the resolution of the color head 62, as to the same K element, a K1 head and a K2 head are placed in two rows. As for the K1 head 130 and the K2 head 132, n pieces of nozzles 130-1 through 130-n, or 132-1 through 132-n are placed in a vertical scanning direction, respectively. Also, the nozzles 130-1 through 130-n, and the nozzles 132-1 through 132-n are placed, being staggered only by a half pitch, so that the resolution of the monochrome head 64 is double the resolution of the color head 62. As to each head installed to the color head 62 and the monochrome head 64, for instance, the Y head 124 is taken here as an example, as shown in FIG. 7, piezoelectric elements 125-1. 125-2 . . . 125-n are installed, individually corresponding to the Y head's nozzles 124-1 through 124-n. To the piezoelectric elements 125-1 through 125-n, color drive waveform signals are individually supplied from the color head drive unit 58 as shown in FIGS. 5A and 5B. Corresponding to the nozzle of the head, a pressure chamber, an ink supply system, and an ink tank are installed, and by means of transmitting the displacement and the pressure generated by the drive of the piezoelectric elements 125-1 through 125-n to the pressure chamber, the printer records characters or images on a record medium, like paper, etc., allowing the nozzle to inject ink particles. The structure of driving the head by the piezoelectric elements 125-1 through 125-n is the same, as to the other M head 126, V head 128, K1 head 130 and the K2 head 132 shown in FIG. 6.

Figure 1:
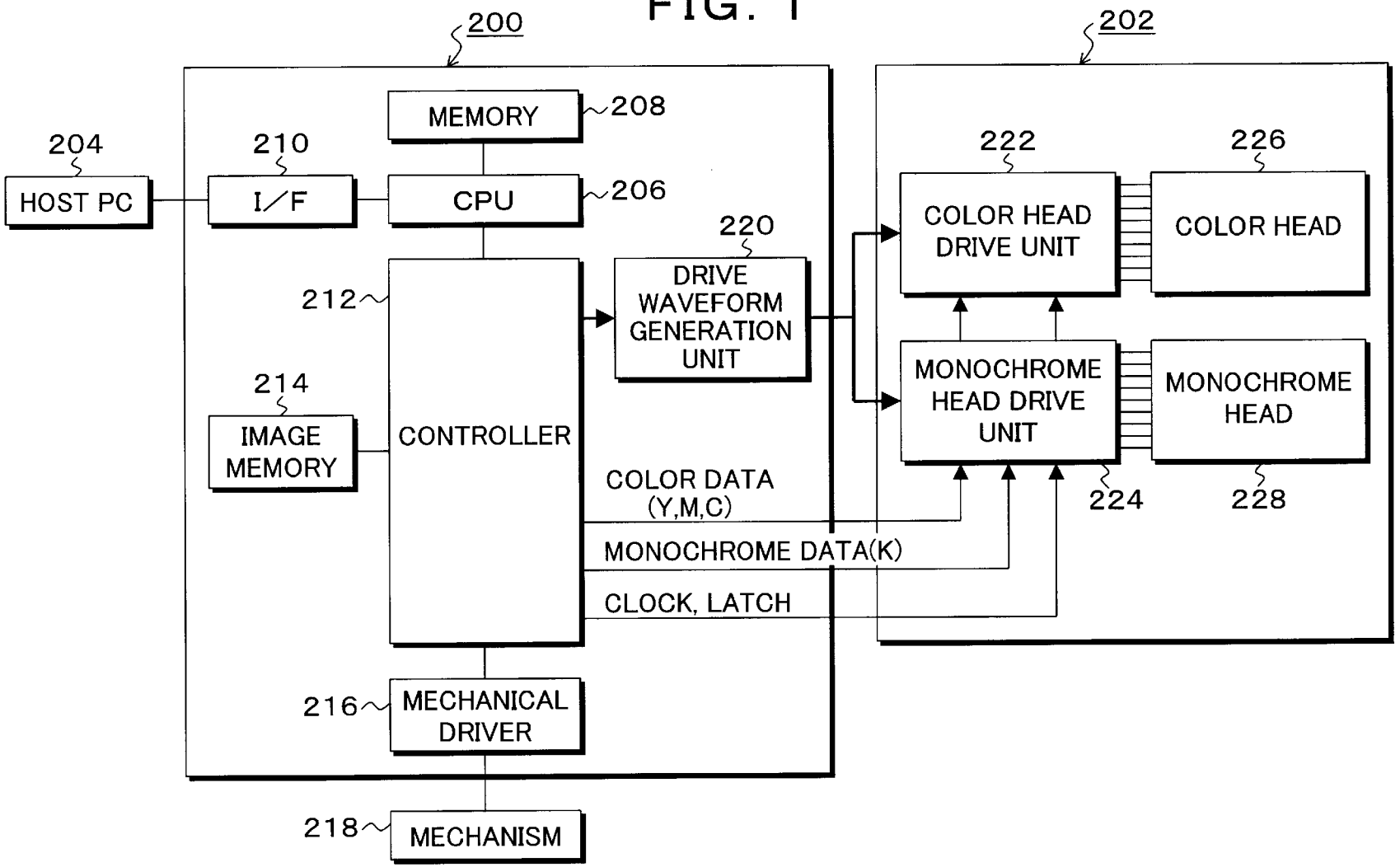
PRIOR ART FIG. 1
FIG. 1 is a block diagram of the conventional ink jet printer.
Figure 2:
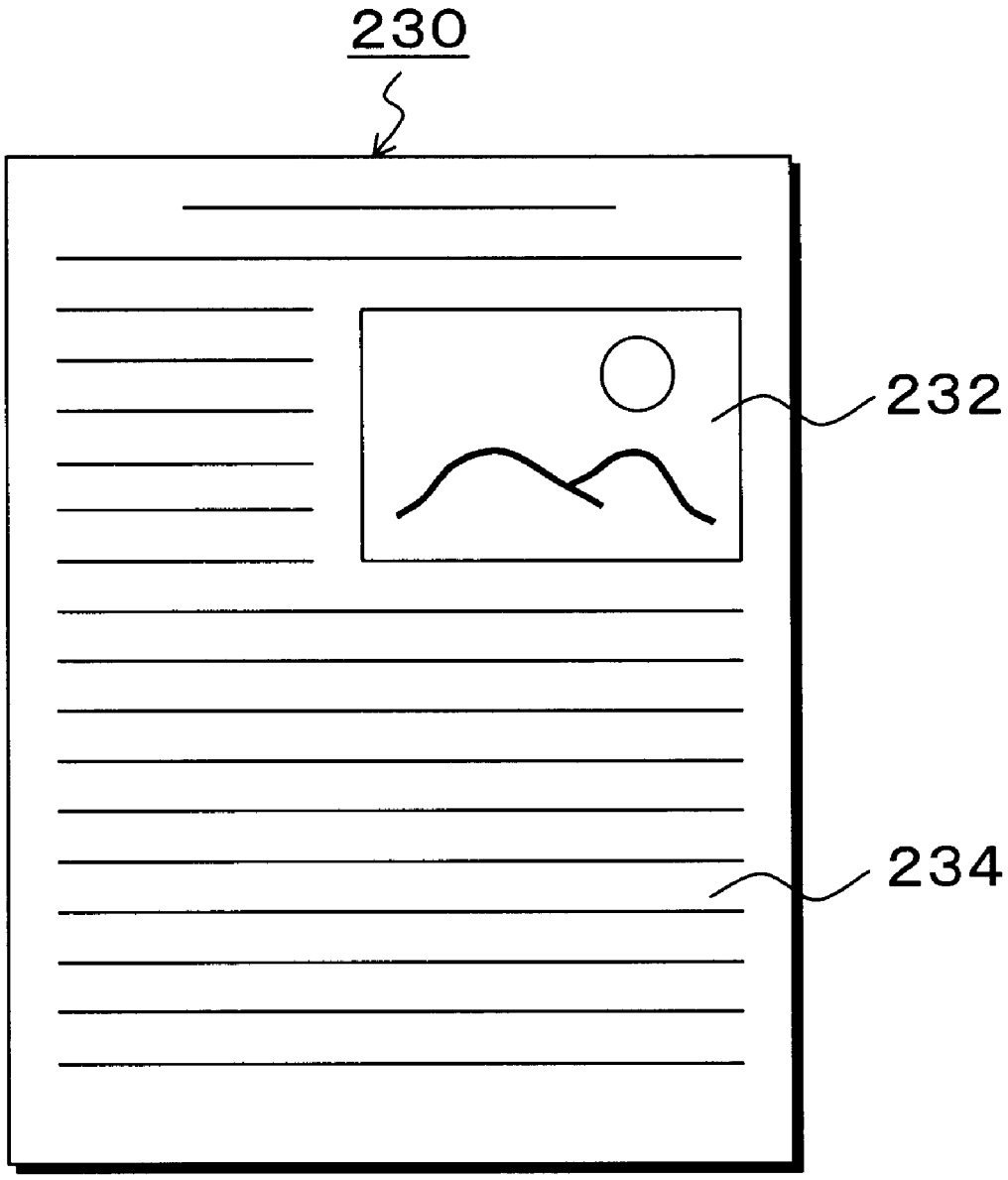
PRIOR ART FIG. 2
FIG. 2 describes printing document containing a color photo in a monochrome text.

Referred again to FIGS. 5A and 5B, in order to allow the printer to perform monochrome printing and color printing by a single scanning, even if there is any intermingled data containing monochrome image like text, etc., and color image, like a photo while the head carrier 36 is scanning in its stroke as shown in FIG. 2, in this embodiment, a color drive waveform generation unit 54 and a monochrome drive waveform generation unit 56 are independently installed to the control unit 34, corresponding to the color head 62 and the monochrome head 64. In this embodiment, when the printer is printing, three types of color drive waveform signals Vwc1, Vwc2 and Vwc3, and also three types of monochrome drive waveform signals Vwk1, Vwk2 and Vwk3 are simultaneously outputted from the color drive waveform generation unit 54 and the monochrome drive waveform generation unit 56. These color drive waveform signals Vwc1 through 3, and the monochrome drive waveform signals Vwk1 through 3 are supplied to a color head drive unit 58 and a monochrome head drive unit 60 of the head carrier 36. The color head drive unit 58 and the monochrome head drive unit 60 of the head carrier 36 are simultaneously controlled by a head control signal including a clock signal and a latch signal sent from the controller 46. Also, the controller 46 supplies the color data consisting of three elements of Y, M and C to the color head drive unit 58, and after selecting whichever one of the three types of color drive waveform signals Vwc1 through 3, depending on the value of the individual color data of Y, M, and C, it further supplies to the piezoelectric element of the nozzle corresponding to the color head 62. Also, the controller 46 supplies K1 monochrome data and K2 monochrome data to the monochrome head drive unit 60, as monochrome data to embody the resolution that is twice as high as the color resolution, and after selecting whichever one of the three types of monochrome drive waveform signals Vwk1 through 3, depending on the individual K1 and K2 monochrome data, it further supplies to the piezoelectric element of the nozzle corresponding to the monochrome head 64. Herein, since the individual color data of Y, M and C allow the color head 62 to express color dots of 4 intensities, and it is accepted to select whichever one of the color drive waveform signals Vwc1 through 3 corresponding to the intensity levels 1, 2 and 3, of the intensity levels 0, 1, 2 and 3, 2-bit data is used. For instance, if the color drive waveform signals Vwc1 through 3 have been set corresponding to the color intensity levels 1, 2 and 3, for the color data "00", any of the color drive waveform signals Vwc1 through 3 is not selected, for the color data "01", the color drive waveform signal Vwc1 is selected, for the color data "10", the color drive waveform signal Vwc2 is selected, and further, for the color data "11", the color drive waveform signal Vwc3 is selected.

The monochrome head 64 uses the K1 head 130 and the K2 head 132 staggered by a half-nozzle pitch in the vertical scanning direction as shown in FIG. 6, so as to embody double the resolution of the color head 62. Also, by using of either one of the K1 head 130 and the K2 head 132 only, it is also possible to embody a resolution of 300 dpi same as the color head 62. Therefore, the monochrome head 64 can perform monochrome printing with a resolution of 300 dpi, selecting either one of the K1 head 130 and the K2 head 132, or with a high-resolution of 600 dpi, selecting both of the K1 head 130 and the K2 head 132. Due to this, like the color data, the K1 and K2 monochrome data from the controller 46 shown in FIGS. 5A and 5B should be 2-bit data.

Here, when the monochrome drive waveform signal Vwk1 sent from the monochrome drive waveform generation unit 56 corresponds to a resolution of 300 dpi, selecting the K1 head 130 shown in FIG. 6, and the monochrome drive waveform signal Vwk2 also corresponds to the same resolution of 300 dpi by the K2 head 132 shown in FIG. 6, and further, the monochrome drive waveform signal Vwk3 corresponds to a high-resolution of 600 dpi, using both of the K1 head 130 and the K2 head 132 shown in FIG. 6, for the monochrome data "00", the printer does not select whichever one of the monochrome drive waveform signals Vwk1 through 3, for the monochrome data "01", it selects the monochrome drive waveform signal Vwk1 of 300 dpi, for the monochrome data "10", it selects the monochrome drive waveform signal Vwk2 of 300 dpi with the dot positions staggered by ½ pitch, and further, for the monochrome data "11", it selects the monochrome drive waveform signal Vwk3 of a high-resolution of 600 dpi.

Figure 8:
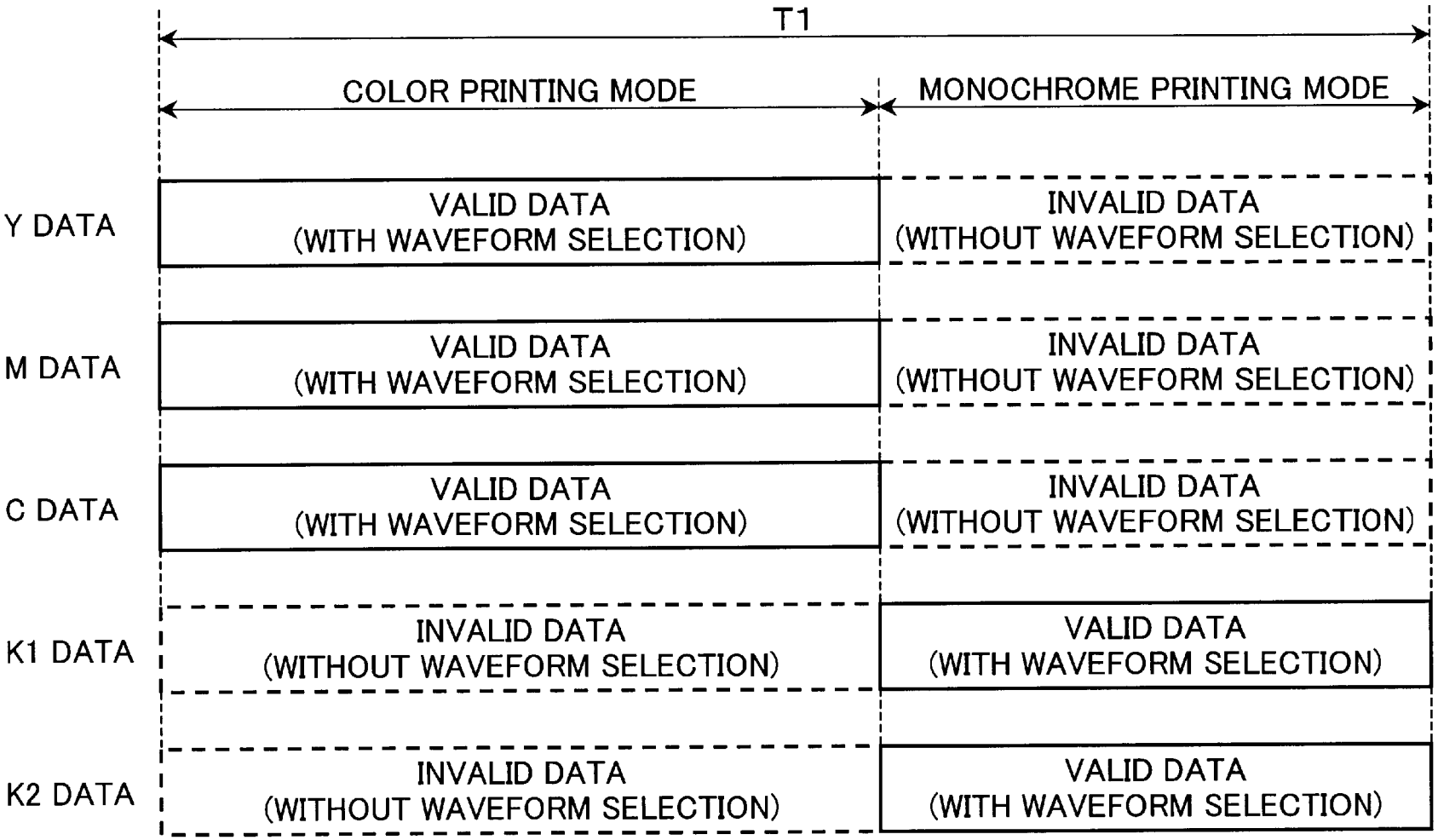
FIG. 8 illustrates the printing mode when color data and monochrome data are intermingled in a single scanning.

FIG. 8 is a time chart showing the selection state of the color drive waveform and the monochrome drive waveform according to the color data and the monochrome data when the head carrier 36 is scanning once in the horizontal scanning direction, in the embodiment shown in FIGS. 5A and 5B, and when the color data and the monochrome data are intermingled during a single scanning. A supposition is made that the color data of the Y, M and C data exist as valid data in the first half of the horizontal scanning period T1, a single scanning of the carrier 36, and in the second half, the monochrome data of the K1 and the K2 data exist as valid data. Here, the valid data means a stream of 2-bit data that can effectively select each drive waveform signal from the color drive waveform generation unit 54, or from the monochrome drive waveform generation unit 56, in the color head drive unit 58, or in the monochrome head drive unit 60, and further, that all data will not become bit "00". On the other hand, invalid data means all data will become bit "00", because the data will not select any drive waveform signal at any dot. Of course, there are some cases when even the valid data may express a intensity of 0 level, and in this case, like the invalid data, the data bit corresponding to that dot with 0 level intensity is "00".

In this manner, within the horizontal scanning period T1, a single scanning of the head carrier 36, the area where the color data of Y, M, and C are valid data will become a color-printing mode, and the area where the K1 and the K2 data are invalid data will become a monochrome-printing mode. Switching between the color-printing mode and the monochrome-printing mode in a single scanning, when the color data and the monochrome data are intermingled, is made by means of the simultaneous generation of the color drive waveform signal and the monochrome drive waveform signal, and if the color data becomes valid and the color drive wave signal has been selected, the printing mode will enter the color-printing mode, and if the monochrome drive waveform signal has been selected, the printer will enter the monochrome-printing mode.

Figure 9:
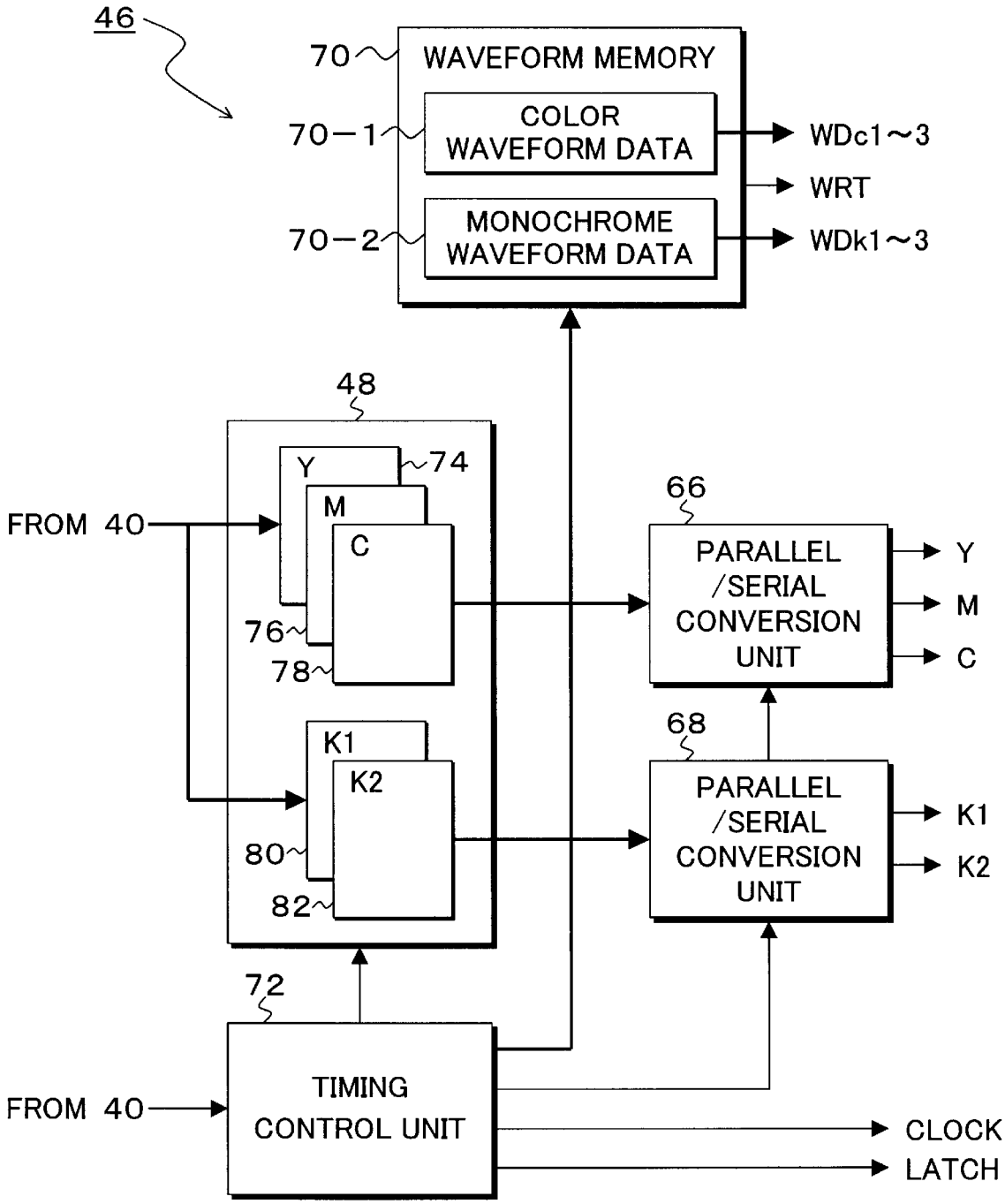
FIG. 9 is a block diagram of a controller shown in FIGS. 5A and 5B.

FIG. 9 shows functions of a controller 46 installed to the control unit 34 shown in FIGS. 5A and 5B, together with an image memory 48. The controller 46 comprises parallel/serial conversion units 66 and 68, a waveform memory 70 and a timing control unit 72. The waveform memory 70 stores a color waveform data 70-1 and a monochrome waveform data 70-2 as a drive unit for a single ink injection from the nozzle. Here, the color waveform data 70-1 stores three types of color waveform data corresponding to color intensity levels 1, 2 and 3, as the color head 62 performs color printing of four intensities of color intensity levels 0, 1, 2 and 3 with 300 dpi. Also, the monochrome waveform data 70-2 stores three types of waveform data, a monochrome drive waveform data to drive the K1 head 130, a monochrome drive waveform data to drive the K2 head 132, and a high-resolution monochrome drive waveform data to drive both of the K1 and the K2 heads, as the printer embodies a high-resolution monochrome-printing of 600 dpi, with the nozzles staggered by a half-nozzle pitch, placing the K1 head 130 and the K2 head 132 in two rows as shown in FIG. 6. Therefore, based on an instruction from the timing control unit 72, from the waveform memory 70, three types of color drive waveform data WDc1 through 3, and monochrome drive waveform data WDk1 through 3 are outputted simultaneously. Further, from the waveform memory 70, a waveform generation timing signal WRT is also simultaneously outputted, that is to be a standard clock for generating a drive waveform.

To the image memory 48, printing data sent from the host computer 38 shown in FIGS. 5A and 5B is processed by the CPU 40 and written. In the printing data sent from the host computer 38, there are monochrome data, color data, and further, intermingled data of monochrome and color data. Therefore, as to the color data, three storage areas of Y plain 74, M plain 76 and C plain 78 are provided for the image memory 48, corresponding to the individual color elements of Y, M and C. Also, as to the monochrome data, two areas of K1 plain 80 and K2 plain 82 are provided, corresponding to public section.

The parallel/serial conversion unit 66 reads out the data of the individual color elements of the Y, M, and C plains 74, 76 and 78 stored in the image memory 48 in synchronization with a single scanning of the head carrier 36, and converts the read-out parallel data into serial data and supplies to the color head drive unit 58 on the side of the head carrier 36 shown in FIGS. 5A and 5B, as the individual serial data of the Y data, M data and the C data. As to the two monochrome image data of the K1 plain 80 and the K2 plain 82 stored in the image memory 48, the parallel/serial conversion unit 66 similarly reads out the data on a single scanning-to-scanning basis, in synchronization with scanning of the head carrier 36, and after converting the read-out parallel data into serial data, supplies to the monochrome head drive unit 60 on the side of the head carrier 36 shown in FIG. 3 as serial data in terms of the K1 data and the K2 data. The timing control unit 72 controls the image memory 48, the parallel/serial conversion units 66 and 68, and timing of the waveform memory 70, receiving a control instruction from the CPU 40, and further outputs a clock signal and a latch signal to the color head drive unit 58 and the monochrome head drive unit 60 of the head carrier 36.

Figure 10:
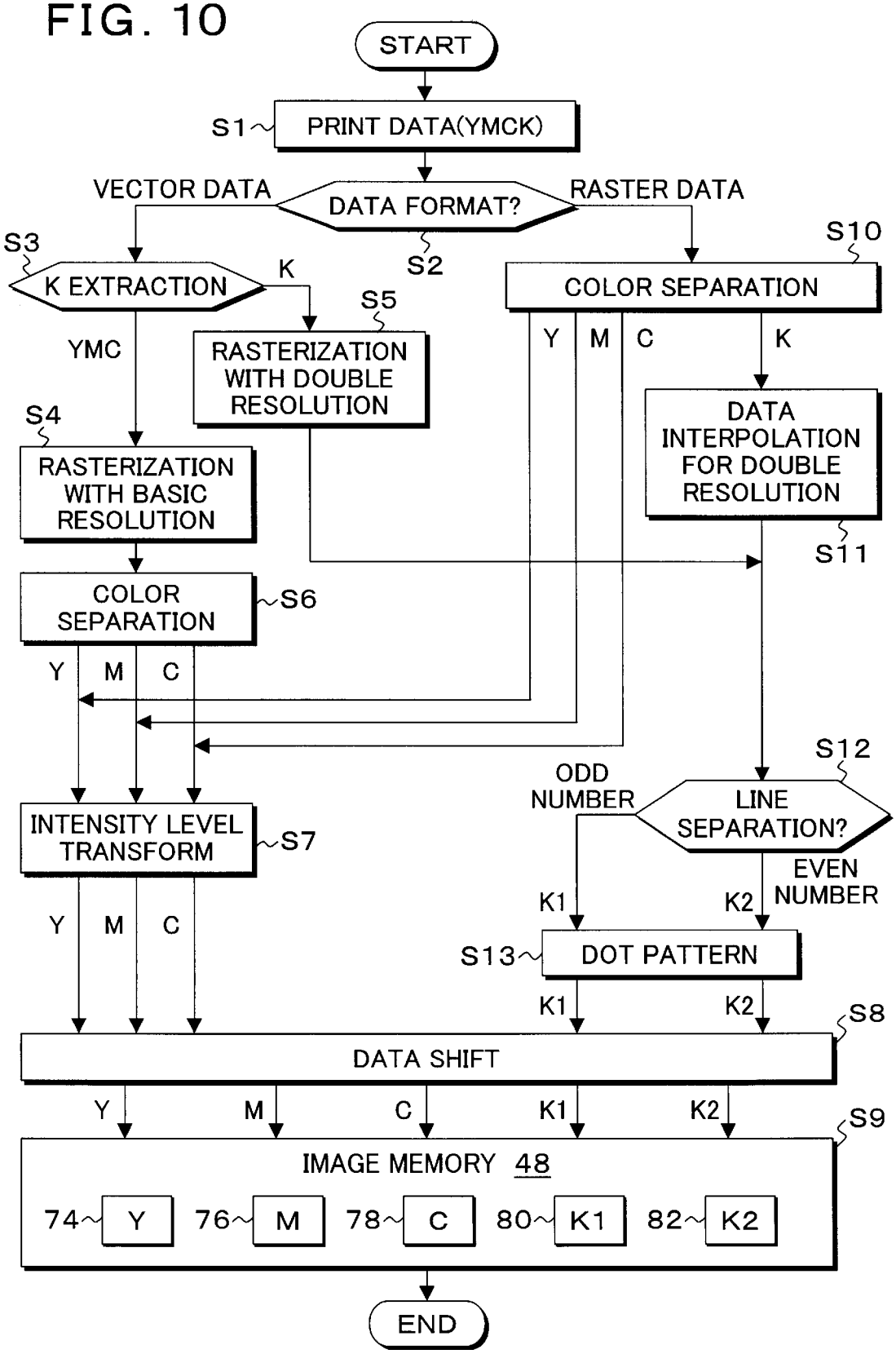
FIG. 10 shows a flowchart of image memory writing processing by the control unit shown in FIGS. 5A and 5B.

FIG. 10 is a flowchart showing the color data and the monochrome data processing procedure by the CPU 40 as to the image memory 48 shown in FIG. 9. When receiving a printing data from the host computer at step S1, the CPU determines data type at step S2. The printing data to be received from the host computer consists of four elements of Y, M, C and K, but the data type is classified into a vector data type and a raster data type. In the raster data type, every dot consists of four elements of Y, M, C and K. While in the vector data type, for instance, character data has data types of font, size, Y, M, C and K. First of all, if the data type is the vector data type, the program goes to step S3, and extracts the K element to separate it from the color elements of Y, M and C. After the K element was extracted, the remaining Y, M and C elements are rasterized at step S4 with a basic resolution. While the K element is rasterized at step S5 with a twice-higher resolution. Next, at step S6, as to the Y, M, and C elements, color separation is performed on the element-by-element basis, and at step S7, intensity level change is performed. In other words, the color elements of Y, M and C are, for instance, 256 intensities, however, because the color head 62 shown in FIG. 6 can express 4 intensities, intensity level is changed from 256 intensities to 4 intensities. Next at step S8, data shift is performed as to the elements of Y, M and C. where intensity change corresponding to the color head 62 has been finished, and at step S9, the data is stored in each of the Y plain 74, M plain 76 and the C plain 78 of the image memory 48 as print data. While, if the data type is a raster data type at step S2, at step 10, the data is separated into the color elements of Y, M and C, and the monochrome element of K. As to the color separated color elements of Y, M and C, at step S7, like the vector type, after intensity level change was performed, data shift is performed at step S8, and at step S9, the data is stored in each of the plains 74, 76 and 78 of Y, M and C in the image memory 48. As to the K element, where color separation was performed at step S10, data interpolation is performed at step S11 for processing with twice-higher resolution. Next, the program goes to step S12, and as to the monochrome data resolved with a twice-higher resolution, odd numbered lines and even numbered lines are separated, and at step S13, these separated lines are converted into monochrome dot patterns in binary, with the odd numbered lines as the K1 monochrome data, and the even numbered lines as the K2 monochrome data. After the binary conversion into dot patterns, the K1 monochrome data and the K2 monochrome data are individually stored in the K1 plain 80 and the K2 plain 82 of the image memory 48 at step S9, after the K1 monochrome data and the K2 monochrome data are data shifted at step S8. Also as to the monochrome data of the K element that was rasterized with a twice-higher resolution after being extracted from the vector data at step S5, after the data is separated into odd numbered lines and even numbered lines at step S12, at step S13, the lines are converted into binary dot patterns, and eventually stored in the K1 plain 80 and the K2 plain 82 of the image memory 48, in the same manner as described above.

Figure 11A:
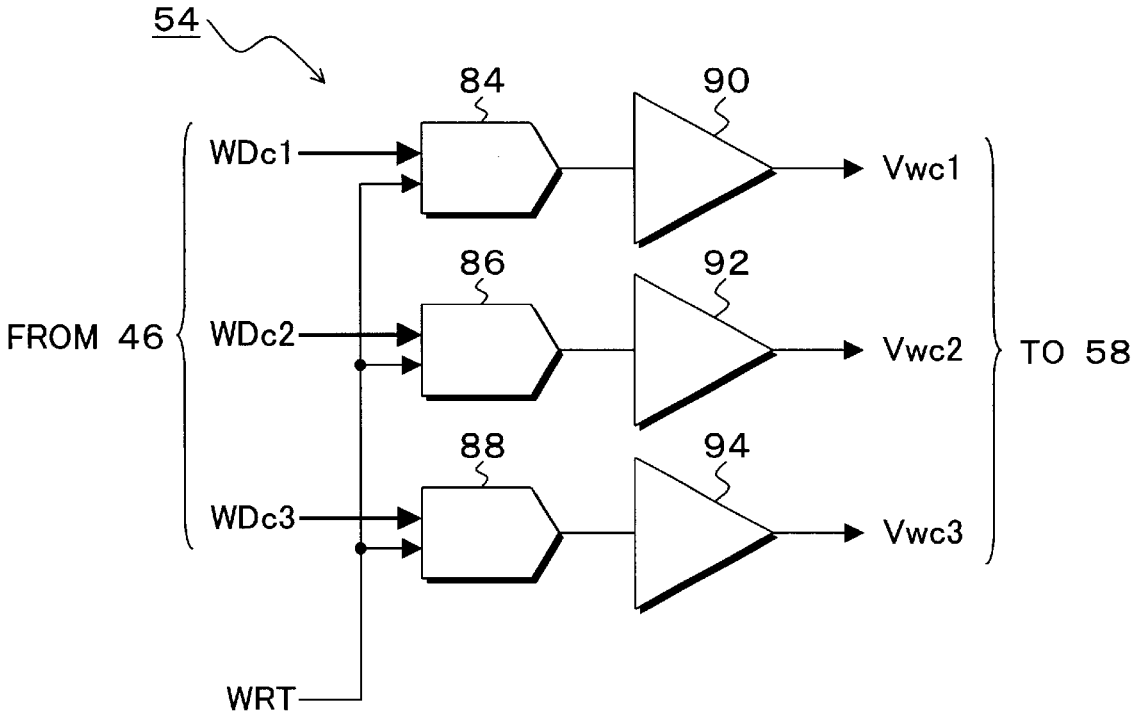
FIGS. 11A and 11B show circuit block diagrams of a color drive waveform generation unit and a monochrome drive waveform generation unit shown in FIGS. 5A and 5B.
Figure 11B:
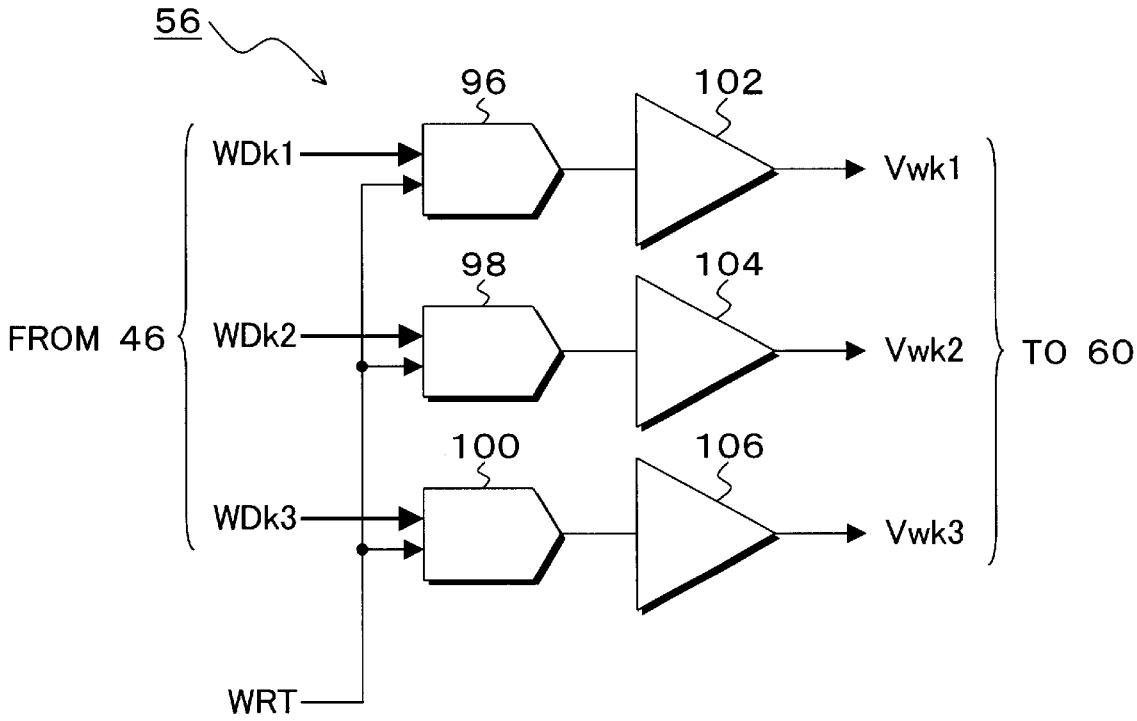

FIGS. 11A and 11B are circuit block diagrams of the color drive waveform generation unit 54 and the monochrome drive waveform generation unit 56 installed to the control unit 34 shown in FIGS. 5A and 5B. FIG. 11A shows the color drive waveform generation unit 54, comprising a DA converters 84, 86 and 88, and amplifiers 90, 92 and 94. To the DA converters 84, 86 and 88, the color drive waveform signals WDc1, WDc2 and WDc3 read from the waveform memory 70 installed to the controller 46 shown in FIG. 8, and a waveform generation timing signal WRT are supplied, and after these signals are converted into analog signals, and amplified with the amplifiers 90, 92 and 94, the resultant three types of color drive waveform signals Vwc1, Vwc2 and Vwc3 are supplied to the color head drive unit 58. FIG. 11B is a circuit block diagram of the monochrome drive waveform generation unit 56 shown in FIGS. 5A and 5B. The monochrome drive waveform generation unit 56 also comprises DA converters 96, 98 and 100, and amplifiers 102, 104 and 106. To the DA converters 96, 98 and 100, the monochrome drive waveform signals WDk1 through WDk3 read from the waveform memory 70 installed to the controller 46 shown in FIG. 8 are individually supplied, and further, a waveform generation timing signal WRT is supplied in common, together with the monochrome drive waveform signals, and after these signals are converted into analog signals, and amplified with the amplifiers 102, 104 and 106, resultant three types of monochrome drive waveform signals Vwk1, Vwk2 and Vwk3 are eventually supplied to the monochrome head drive unit 60.

FIGS. 12A to 12G illustrate waveforms of each drive waveform signal of color and monochrome outputted from the color drive waveform generation unit 54 and the monochrome drive waveform generation unit 56 shown in FIGS. 11A and 11B, and printing states of color dots and monochrome dots corresponding to each waveform drive signal.

Figures 12A, 12B, 12C, 12D, 12E, 12F, 12G, 12H, 12I, 12J:
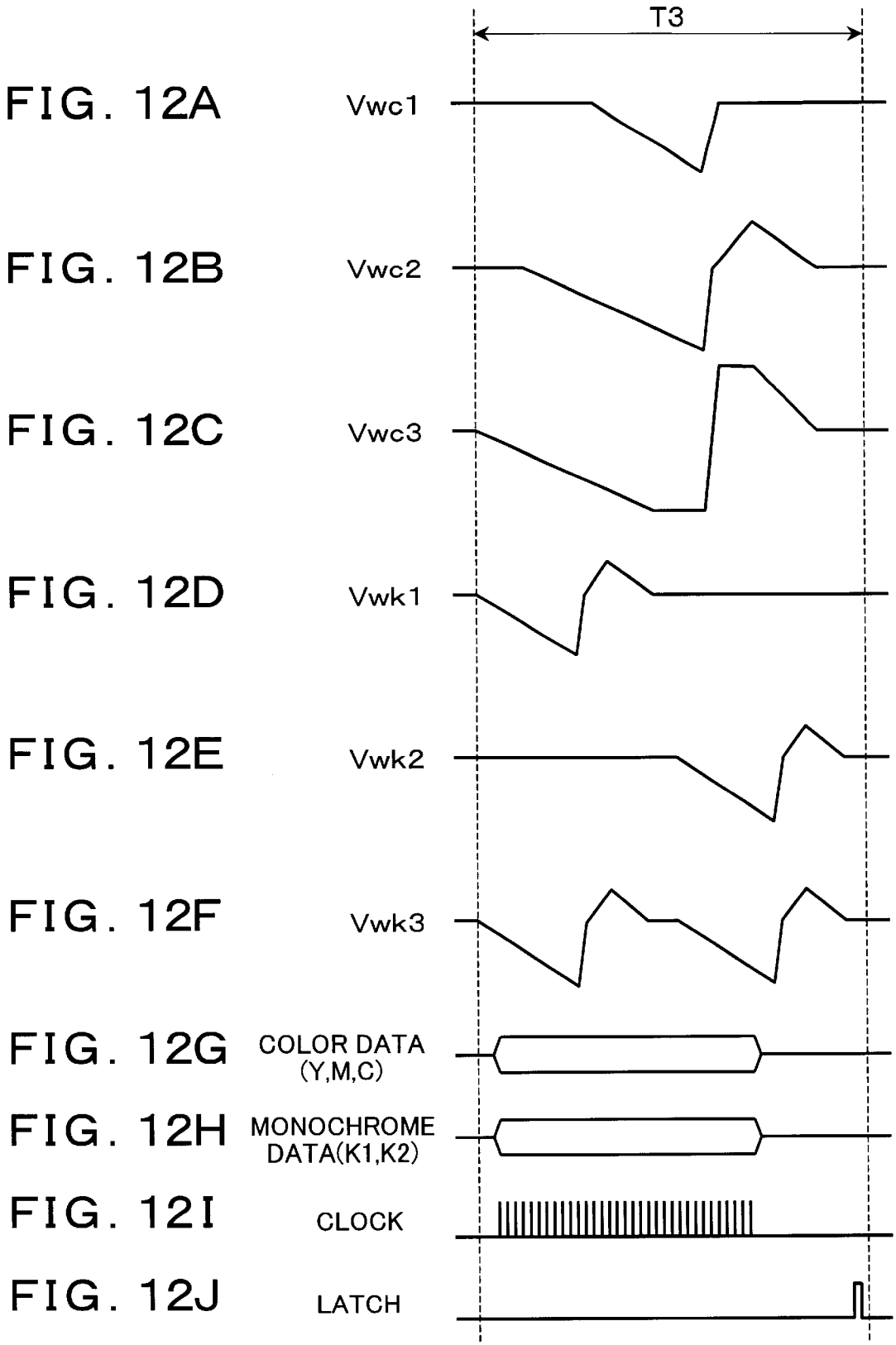
FIGS. 12A to 12P illustrate color dot and monochrome dot corresponding to the color drive waveform, monochrome drive waveform and individual drive waveform.
Figure 12K:
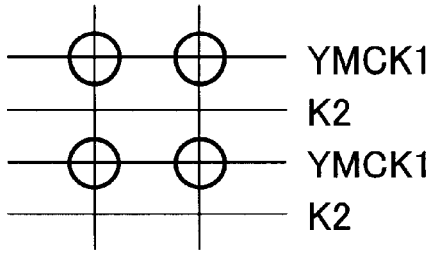
Figure 12L:
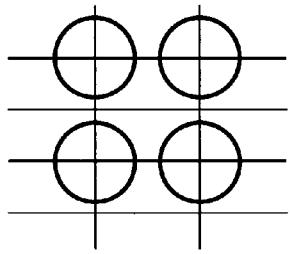
Figure 12M:
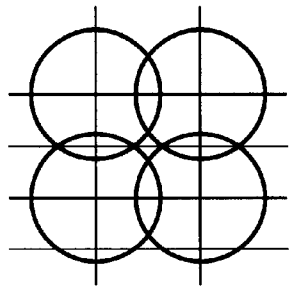
Figure 12N:
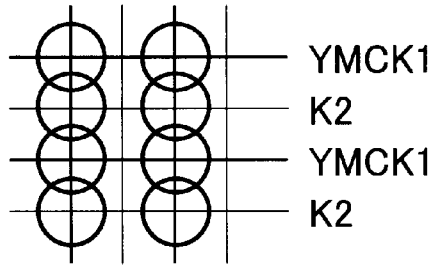
Figure 12O:
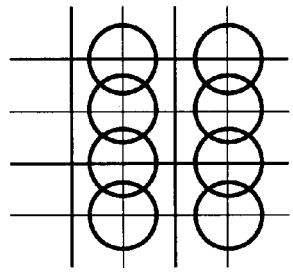
Figure 12P:
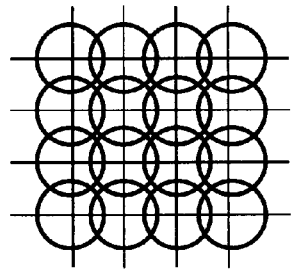

FIGS. 12A to 12C show color drive waveform signals Vwc1 through 3 corresponding to intensity levels 1, 2 and 3, and FIGS. 12K, 12L and 12M show color dots printed by each color drive waveform. Further, FIGS. 12D, 12E and 12F show three types of monochrome drive signals Vwk1, Vwk2 and Vwk3, and FIGS. 12N, 12O and 12P show monochrome dots corresponding to each drive waveform signal. Moreover, FIGS. 12G, 12H and 12I and 12J show time charts of color data to be used for selecting a color drive signal, monochrome data, clock and latch. The color drive waveform signals Vwc1 through 3 shown in FIGS. 12A to C print color image of intensity levels 1, 2 and 3 having different dot sizes as shown in FIGS. 12K to 12M, by controlling the amount of ink to be injected. While, waveforms of the monochrome drive waveform signals Vwk1 through 3 shown in FIGS. 12D to 12F have double the frequencies of the color drive waveform signals Vwc1 through 3. Of these, the monochrome drive waveform signal Vwk1 shown in FIG. 12D is a single-appearing waveform of the first half within the waveform of two-fold frequency, and the monochrome drive waveform signal Vwk2 shown in FIG. 12E is a single-appearing waveform of the second half within the waveform of two-fold frequency. Further, the monochrome drive waveform signal Vwk3 shown in FIG. 12F can allow the printer to make monochrome printing with a twice-fold resolution like shown in FIG. 12P, as this signal forms a double waveform, having two waveforms both at the first half and the second half. As to the generation of the color drive waveform signals Vwc1 through 3, and the monochrome drive waveform signals Vwk1 through 3, the color data and the monochrome data are simultaneously generated as a head control signal, and further, head control signals of the clock and the latch are also generated in common, therefore, by this generation method, the printer can embody high-speed printing, by substantially switching between the color printing mode and the monochrome printing mode, even if the color data and the monochrome data are intermingled while the head carrier 36 is scanning in its stroke once. In other words, according to the present invention, the printer can perform both of color printing and monochrome printing by a single scanning of the head carrier 36, regardless of the difference between the color printing mode with multi-intensities, and the monochrome printing mode with a high resolution, thereby allowing the printer to embody high-speed and high-quality printing.

Figure 13A:
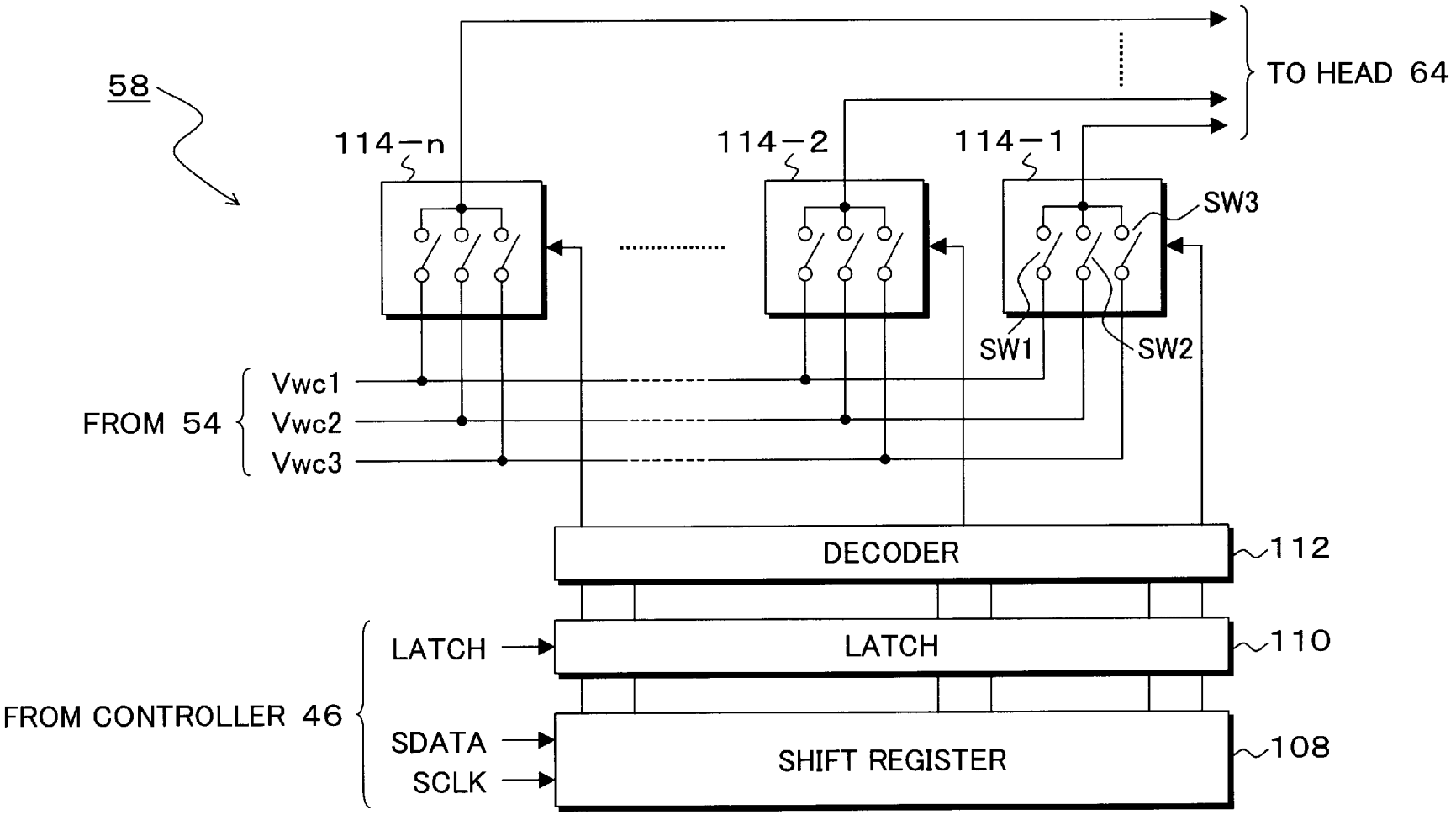
FIGS. 13A and 13B show circuit block diagrams of a color head drive unit and a monochrome head drive unit shown in FIGS. 5A and 5B.
Figure 13B:
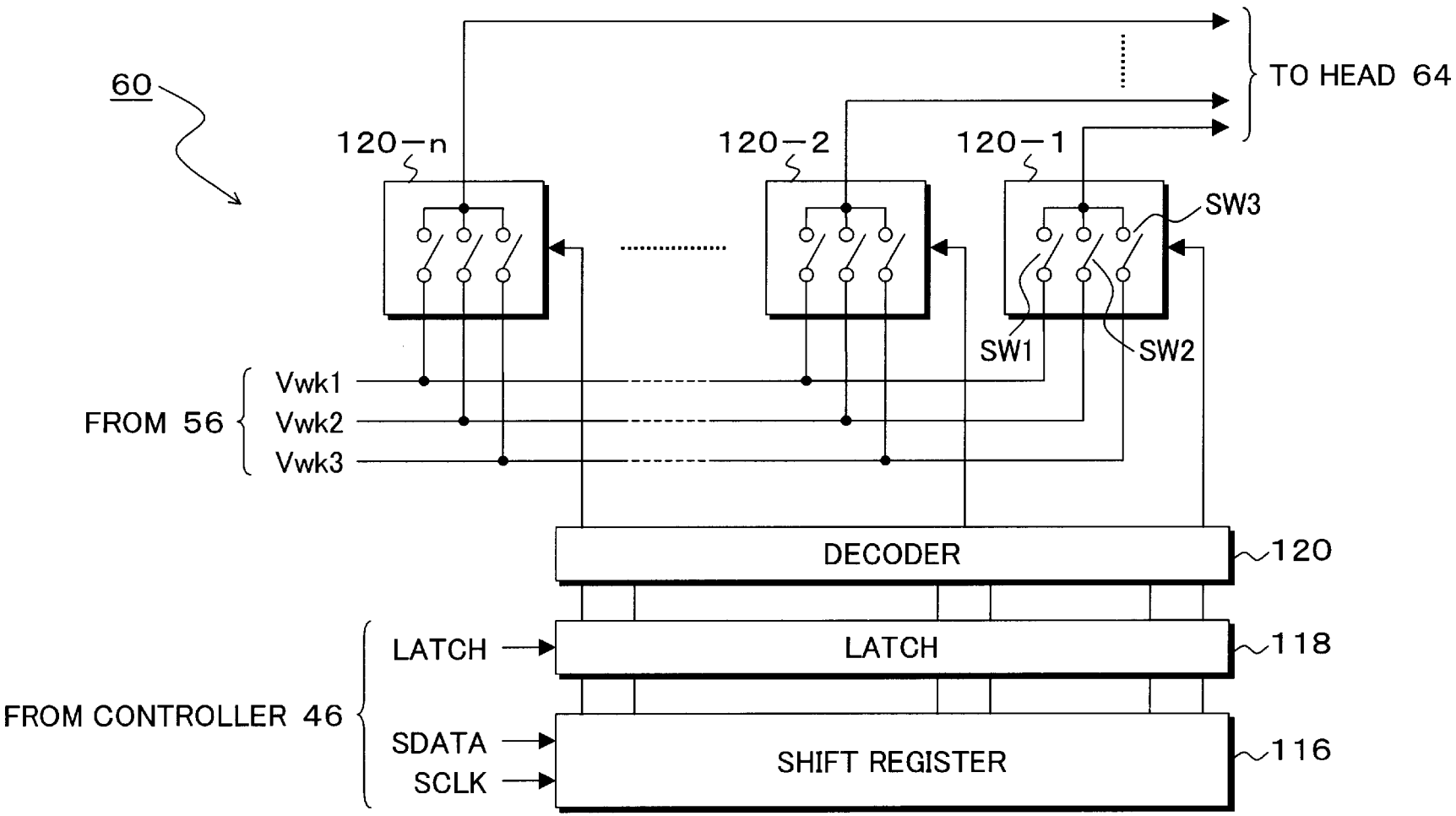

FIGS. 13A and 13B show circuit block diagrams of the color head drive unit 58 and the monochrome head drive unit 60 installed to the head carrier 36, shown in FIGS. 5A and 5B. First, FIG. 13A relates to the color head drive unit 58, and shows a circuit unit corresponding to, for instance, the Y head 124 installed to the color head 62 shown in FIG. 6. The color head drive unit 58 comprises a shift register 108, a latch 110, a decoder 112 and analog multiplexers 114-1, 114-2, . . . 114-n, the number of which corresponds to the number of nozzles of the Y head 124. To the shift register 108, the color dot data corresponding to the number of nozzles (n) in the vertical scanning direction of the Y head 124 shown in FIG. 6 is continuously inputted by clock, after being connected in the horizontal scanning direction. To the latch 110, a latch signal is given, in synchronization with the entry of n pieces of dots same as the n pieces of nozzles of the Y head 124 against the shift register 108, and n pieces of dot data is latched corresponding to the n pieces of nozzles. As the dot data held in the latch 110 is 2-bit data indicating four intensities, the decoder 112 converts the 2-bit data into a selection signal of the analog multiplexers 114-1 through 114-n. The analog multiplexers 114-1 through 114-n have three switches SW1, SW2, and SW3, and here, the analog multiplexer 114-1 is taken to show a typical case. The switch SW1 selects the color drive waveform signal Vwc1 of intensity level 1, and supplies the selected signal to the piezoelectric element of the corresponding nozzle. The switch SW2 selects the color drive waveform signal Vwc2 of intensity level 2, and supplies the selected signal to the piezoelectric element of the corresponding nozzle. Further, the switch SW3 selects the color drive waveform signal Vwc3 of intensity level 3, and supplies the selected signal to the piezoelectric element of the corresponding nozzle.

Figures 14A, 14B, 14C:
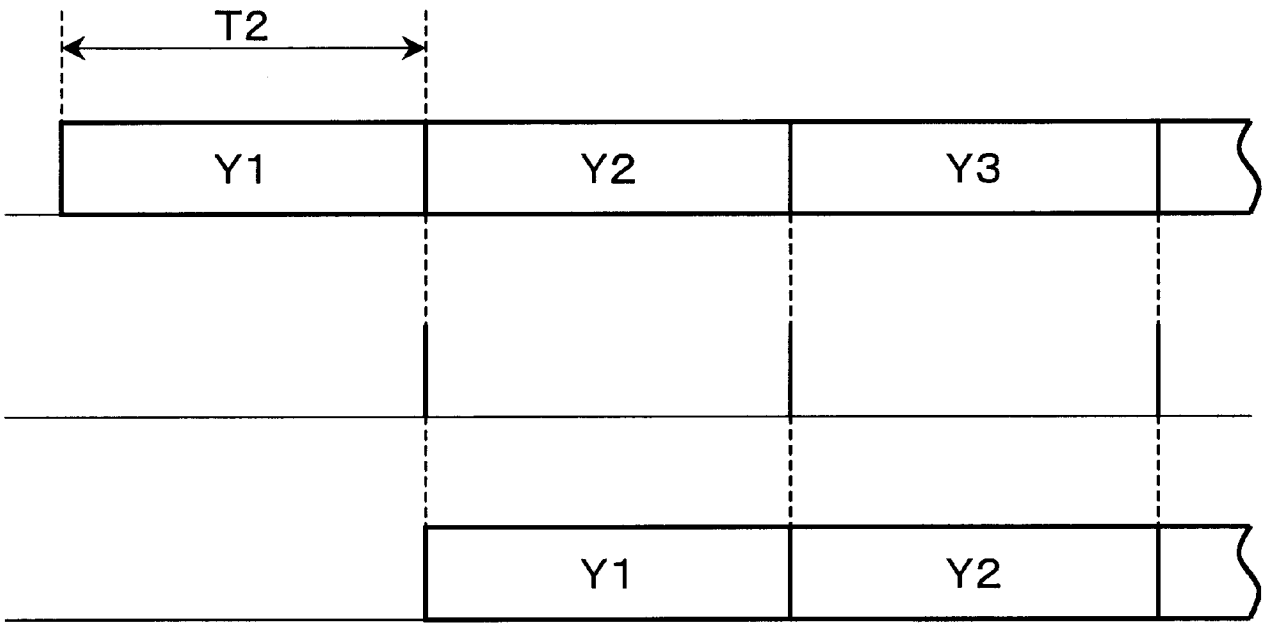
FIGS. 14A to 14C show a time chart for shift, latch and drive waveform output as to Y data.

FIGS. 14A to 14C show a time chart of the Y data shift, latch and drive waveform output of the color head drive unit corresponding to the Y head shown in FIG. 13A. First, as shown in FIG. 14A, to the shift register 108, the n pieces of dot data of the Y element corresponding to the arrangement direction of nozzles for the Y head 124 shown in FIG. 6 are continuously shifted as the data Y1, Y2 and Y3 that are arranged in the horizontal scanning direction, on n pieces-to-n pieces basis in the vertical scanning direction. When the Y1 data including the color dot data, the number of which corresponds to the n pieces of nozzles of the Y head 124 is shifted to the shift register 108, the latch 110 performs latching movement in that timing, and like the drive waveform output shown in FIG. 14C, during the next period T2 of single pixel scanning in the main direction, from the decoder 112, a selection signal (including not-selecting all) of the switches SW1 through SW3 that already decoded the n pieces of the dot data (2 bits) of the Y element is individually outputted to the analog multiplexers 114-1 through 114-n. At this time, the data Y2 of the Y element for the n pieces of the next nozzles is already shifted to the shift register 108. After that, the process is repeatedly performed every period T2 of single pixel scanning in the horizontal scanning direction.

Figures 15A, 15B, 15C:
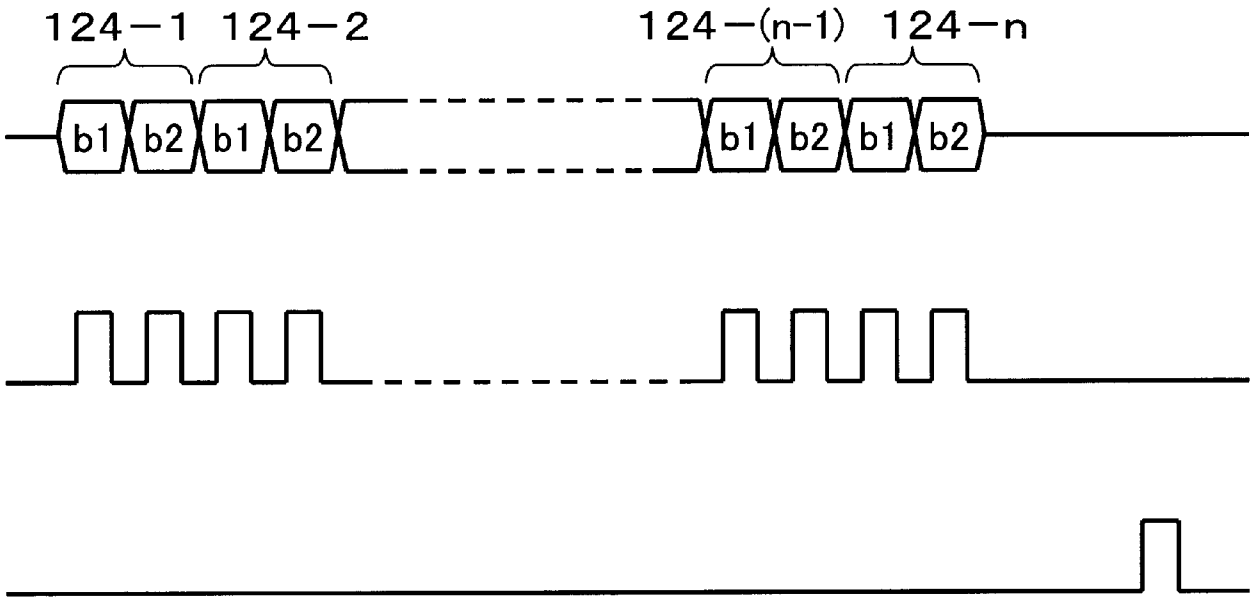
FIGS. 15A to 15C show a timing chart for the Y data, clock and latch, against the nozzle row of the Y head shown in FIG. 6.

FIGS. 15A to 15C show shift of the Y1 data and clock, and further latch shown in FIGS. 14A to 14C, more specifically. FIG. 15A shows the Y data, and the dot data of 2 bits, b1 and b2, corresponding to the nozzles 124-1 through 124-n of the Y head 124 shown in FIG. 6, is shifted in synchronization with the clock shown in FIG. 15B. And, in the timing after the dot data of 2 bits corresponding to the n pieces of the nozzles was shifted, a latch signal is obtained as shown in FIG. 15C, and after the decoder 112 decoded the latched n pieces of 2 bit data, whichever one of the color drive waveform signals Vwc1 through 3 by the switch selection of the analog multiplexers 114-1 through 114-n will be selectively outputted, or not-selecting all will be performed.

While, FIG. 13B shows a circuit block diagram of the monochrome head drive unit 60 installed to the head carrier 36, shown in FIGS. 5A and 5B. In the monochrome head drive unit 60, the circuit configuration is basically the same as the configuration in the color head drive unit 58 shown in FIG. 13A. In other words, the monochrome head drive unit 60 comprises a shift register 116, a latch 118 and analog multiplexers 120-1 through 120-n, the number of which corresponds to the n pieces of the nozzles for the K1 head and the K2 heads 130 and 132 shown in FIG. 6. Clock and latch signals to the shift register 116 and the latch 118 from the controller 46 are the same signal as the signals to be sent to the latch 110 and the shift register 108 of the color head drive unit 58 shown in FIG. 13A. In addition, as the individual monochrome data for the n pieces of nozzles of the monochrome head, in other words, the K1 head or the K2 head, to be latched by the latch 118 is 2-bit data, it is so programmed that at the bit 01, the monochrome drive waveform signal Vwk1 is selected, with, for instance, the switch SW1, representing the analog multiplexer 120-1, turned ON, at the monochrome data bit 10, the monochrome drive waveform signal Vwk2 is selected, with the switch SW2 selected, and further, at the monochrome data bit 11, the monochrome drive waveform signal Vwk3 is to be selected.

A logic chart shown in FIG. 16 shows systematically arranged conditions for selecting drive waveforms based on the individual color and monochrome dot data of the color head drive unit 58 shown in FIG. 13A and the monochrome head drive unit 60 shown in FIG. 13B. In the logic chart, the color or monochrome dot data is 2-bit data of "b1 and b2" bits, and depending on the 2-bit data "b1, b2", selection of drive waveforms by the analog multiplexers 114-1 through 114-n is determined. In other words, as to the color data of Y, M and C, at the dot data "00", any drive waveform is not selected, at "01", the drive wave form Vwc1, at "10", the drive waveform Vwc2, and at the "11", the drive waveform Vwc3 will be individually selected. Also, as to the monochrome heads of the K1 and the K2, any drive waveform is not selected at the dot data "00", the drive waveform Vwk1 at "01", at "10", the drive waveform Vwk2, and at "11", the drive waveform Vwk3 will be individually selected.

Figures 17A, 17B, 17C, 17D, 17E, 17F, 17G, 17H, 17I, 17J, 17K, 17L, 17M, 17N:
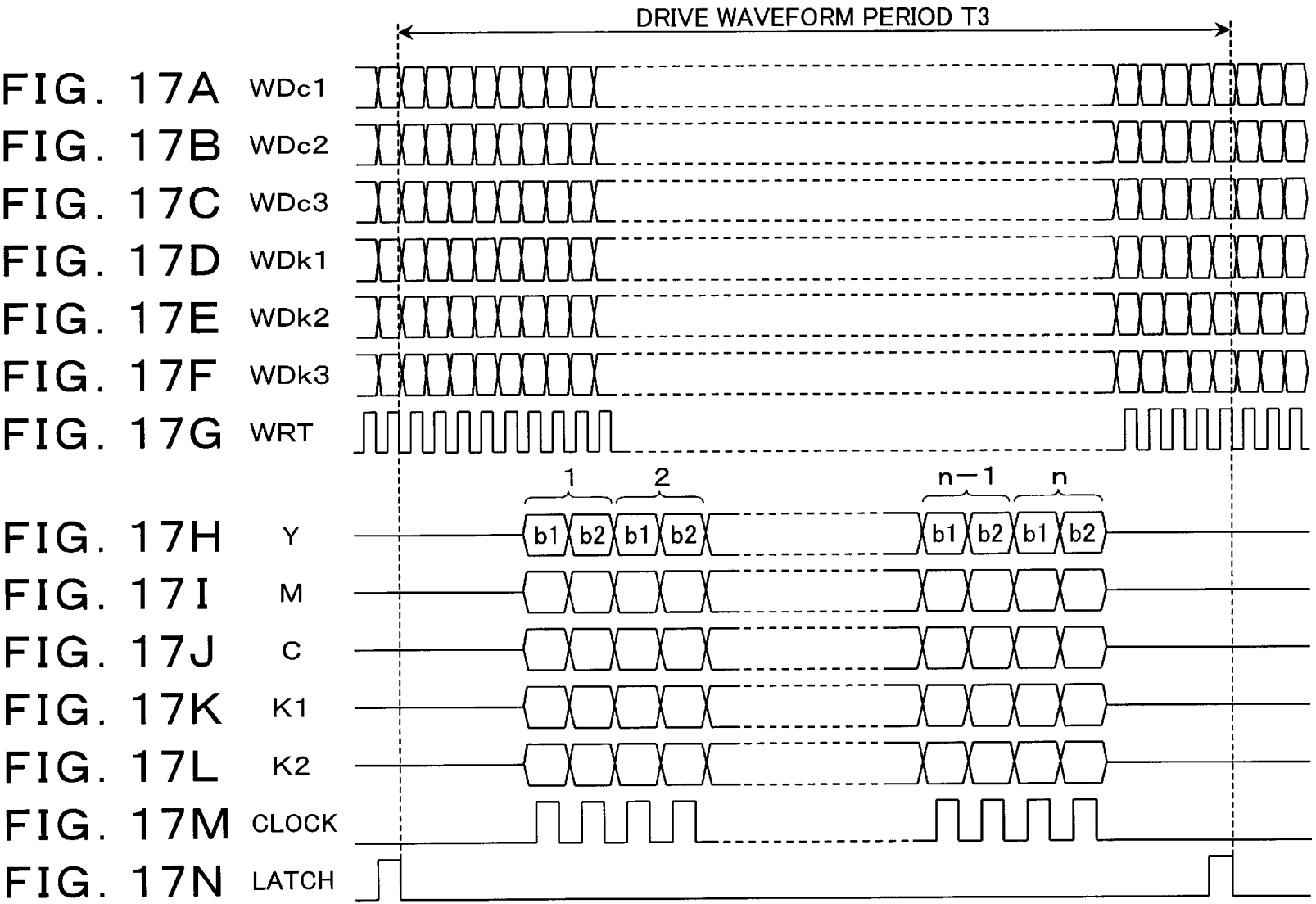
FIGS. 17A to 17N show time charts of data, clock and latch corresponding to the nozzle row of each head shown in FIG. 6.

FIGS. 17A to 17N are time charts of the color waveform data, the color data and the monochrome data, and further a head control signal to be outputted from the controller 46 shown in FIG. 8 throughout the drive waveform period T3 to output drive waveform signals to each of the n pieces of the nozzle rows at each of the color head 62 and the monochrome head 64 shown in FIG. 6.

FIGS. 17A to 17C show color waveform data WDc1 through 3 to be outputted from the waveform memory 70 shown in FIG. 8, and each block has digital value, for instance, 8 bits corresponding to each analog level at the color drive waveform signals Vwc1 through 3, individually shown in FIGS. 12A to 12C.

Also, FIGS. 17D to 17F show monochrome drive waveform signals Vwk1 through 3 to be outputted from the waveform memory 70 shown in FIG. 9, and each block has digital value, for instance, 8 bits corresponding to the individual analog level of the monochrome drive waveform signals Vwk1 through 3 shown in FIGS. 12D to 12F. The color and the monochrome waveform data shown in FIGS. 17A to 17F are supplied to the color drive waveform generation unit 54 and the monochrome drive waveform generation unit 56 shown in FIGS. 11A and 11B, together with the waveform generation timing signal WRT shown in FIG. 17G, and converted into analog drive waveform signals shown in FIGS. 12A to 12F by the DA converters 84, 86, 88, 96, 98 and 100.

Together with the color drive waveform data and the monochrome drive waveform data, the color data of Y, M and C shown in FIGS. 17H to 17L, and the monochrome data of K1 and K2 are supplied to the parallel/serial conversion unit 66 and the parallel/serial conversion unit 68 installed to the controller 46, as n pieces of dot data corresponding to 2 bits b1 and b2 per one nozzle as shown for the Y data. Also, simultaneously with the supply of these color data and monochrome data, a clock signal shown in FIG. 17M and a latch signal shown in FIG. 17N are supplied, so that the printer can make high-speed and high-quality printing, changing the printing mode while the head carrier 36 is scanning once, selecting the appropriate color drive waveform signal or the monochrome drive waveform signal depending on the color data or the monochrome data, being ready for different printing modes, like multi-intensity color printing mode by the color head, or high-resolution monochrome printing mode by the monochrome head.

Figure 18:
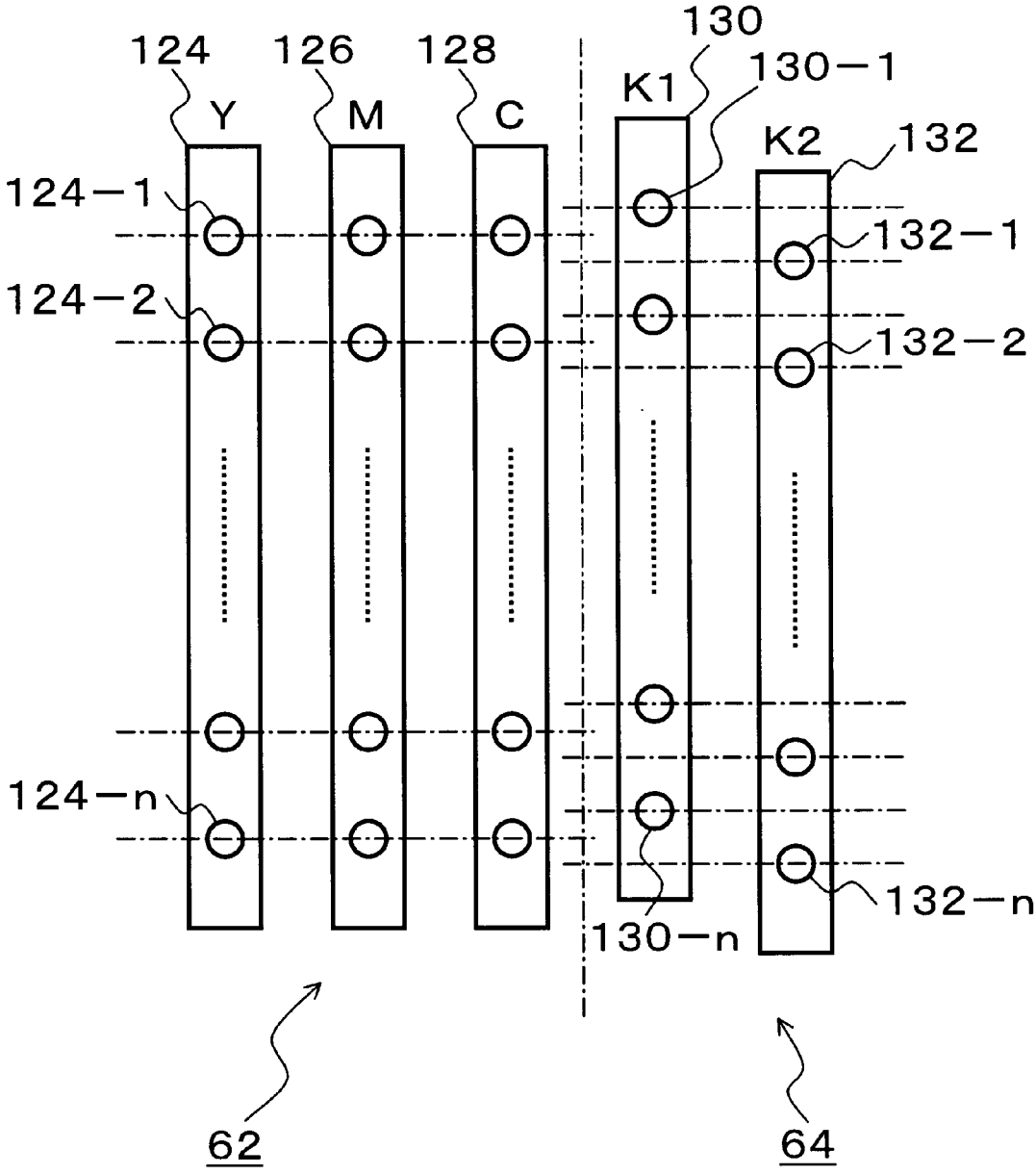
FIG. 18 illustrates nozzle layouts for another color head and monochrome head to be used by the present invention.
Figure 19B:
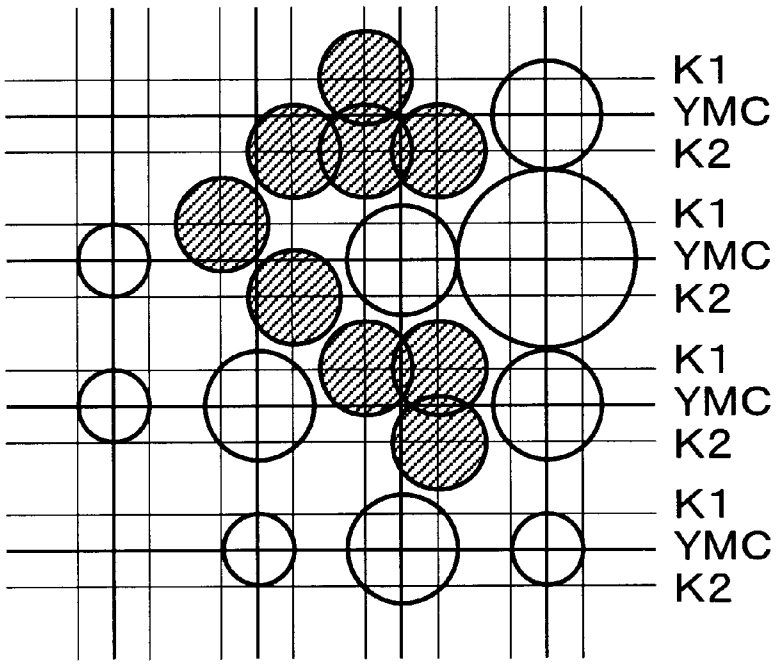
FIGS. 19A and 19B illustrate the comparison of dot layouts for UCR processing to replace the gray area in a color image with monochrome, as to the heads shown in FIGS. 6 and 18.
Figure 19A:
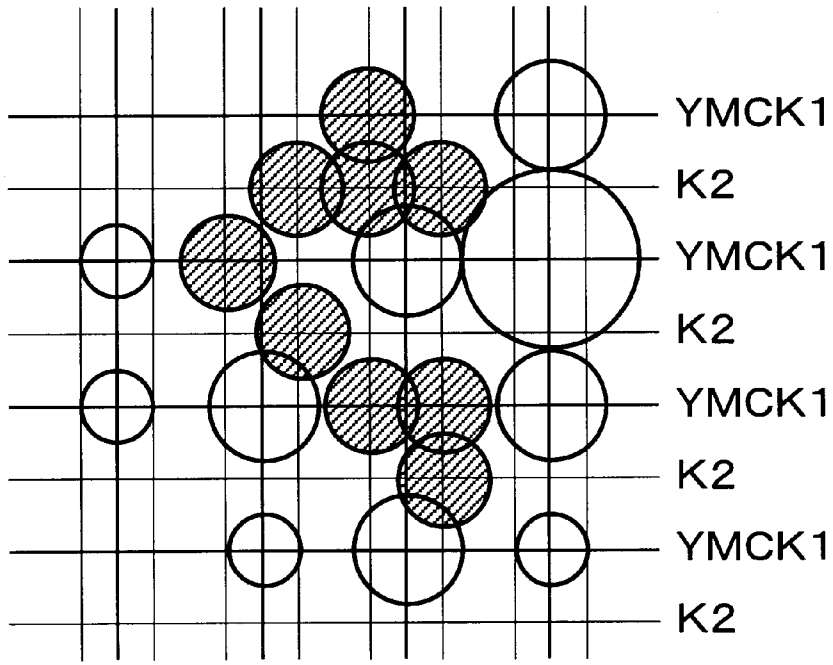

FIG. 18 illustrates nozzle layout as another embodiment of the color head and the monochrome head to be used by the ink jet printer in accordance with the present invention. In the nozzle layout in the embodiment shown in FIG. 6, the nozzles of the Y head 124, the C head 126, the M head 128 and the K1 head 130 are placed in the same line, but the position of the nozzle of the K2 head is staggered by a half pitch. Due to the layout, when processing (UCR processing) is performed to replace the gray section in the color image with monochrome ink, as represented by diagonally shaded monochrome dots shown in FIG. 19A, the dots marked by the K2 head 132 partly cover the color dots of Y, M and C denoted by circles (○), thereby causing a problem that the color dots become unclear and dirty image. While in the nozzle layout shown in FIG. 18, against the side of the color head 62 of the Y head 124, the C head 126 and the M head 128 that have the same nozzle layout, a configuration is made so that the nozzles 130-1 through 130-n of the K1 head 130 for the monochrome head 64 are shifted, for instance, by ¼ pitch upward as indicated in the drawing, and at the same time, the nozzles of the K2 head are shifted by ¼ pitch downward, to be opposite to the state indicated in the drawing. By this configuration of the nozzle layout of the monochrome head 64, if processing (UCR processing) is performed to replace the gray area in the color image with monochrome ink, as shown in FIG. 19B, the possibility of the monochrome dots represented by diagonal lines to partly cover the color dots represented by (○) can be lower so that the image quality can be improved. In addition, monochrome printing uses 2×2 dots as one pixel, and when the number of the monochrome dots within one pixel is changed, even if monochrome printing of two intensities, intensity expression can be made. In other words, by mixing of different printing modes, like the color printing mode using dot intensity with variable color dot diameter, and the monochrome printing mode using area intensity where number of dots within a pixel can be varied within the range of 1 through 4, high image quality can be made, even if in the color image treated with UCR processing.

Moreover, the embodiment described above takes the case as an example, where the resolution of the monochrome head both in the horizontal scanning direction and the vertical scanning direction is set twice as high as the resolution of the color head, however, the resolution of the monochrome head is not limited to double the resolution of the color head, and it is needless to say that the embodiment can include a high-resolution of appropriate multiple. Also, a higher-resolution mode of the monochrome head compared to the color head can be embodied, only when the following conditions have been set:

(1) To set an integral multiple of the resolution of the color head 62 for the resolution of the monochrome head 64 in the horizontal scanning direction;
(2) To set an integral multiple of the color head 62 for the ink injection cycle of the monochrome head 64;
(3) To set the same multiple of the ink injection cycle of the monochrome head 64 for the ink injection cycle of the color head 62, as the multiple of the resolution in the vertical scanning direction of the monochrome head 64 set for the resolution in the vertical scanning direction of the color head 62;
(4) To set an integral multiple of the resolution in the vertical scanning direction of the color head 62 for the resolution in the vertical scanning direction of the monochrome head 64;
(5) To set an integral multiple of the number of nozzle lines for each color of the color head 62 for the number of nozzle lines of the monochrome head 64; and
(6) To set the same multiple of the number of nozzle lines of the monochrome head 64 for the number of nozzle lines for each color of the color head 62, as the multiple of the resolution of the monochrome head 64 set for the resolution of the color head 62 in the horizontal scanning direction.

The present invention also includes any appropriate variations that would not impair the object and advantage of the present invention. Further, the present invention is not restricted by numerical values given in the embodiments as shown above.

Industrial Applicability

According to the present invention, with the color head and the monochrome head, both of which are mounted on the same head carrier, the printer can make printing, while switching between the color printing mode and the monochrome printing mode to be selected depending on the color data or the monochrome data, within a single scanning, and in addition, since the printer can make intermingled printing of color printing and monochrome printing during a single scanning of the head carrier, as to a report or a text, containing a mixture of a color image rich in gradation expression, such as a photo or full-color picture, etc., and a detailed and clear monochrome line-drawing, the ink jet printer that prints with high-speed can be embodied.

By means of setting a multivalued intensity mode for the color printing mode, and a high-resolution mode for the monochrome printing mode, the printer can make color and monochrome intermingled printing with high-speed within a single scanning of the head carrier, and at the same time, in color printing and monochrome printing, high image quality can be embodied.

What is claimed is:

1. An ink jet printer comprising:

a color head having a plurality of nozzles arranged on a head carrier, each of the plurality of nozzles injecting color ink particles by the drive of a piezoelectric element; and a monochrome head having a plurality of nozzles arranged the head carrier, each of the plurality of nozzles injecting monochrome ink particles by the drive of a piezoelectric element; wherein the ink jet printer comprises a control unit which, within a single scanning of the head carrier, switches the printing mode between a color printing mode by the color head and a monochrome printing mode by the monochrome head, to thereby provide a control of printing, wherein the control unit includes a color drive waveform generation unit to drive the color head and a monochrome drive waveform generation unit to drive the monochrome head in which the color drive waveform generation unit and the monochrome drive waveform generation unit are independent units that may operate simultaneously.

2. The ink jet printer according to claim 1, wherein the control unit includes:

the color drive waveform generation unit which simultaneously generates a group of color drive waveforms representative of at least two types of color dots;

the monochrome drive waveform generation unit which simultaneously generates a group of monochrome drive waveforms representative of at least two types of monochrome dots;

a color data output unit which outputs color data for a single scanning from a color image, in synchronism with a single scanning of the head carrier;

a monochrome data output unit which outputs monochrome data for a single scanning from a monochrome image, in synchronism with a single scanning of the head carrier;

a color head drive unit which selects one waveform from the group of color drive waveforms, based on the color data, the color head drive unit supplying the selected one waveform to the piezoelectric element of the color head for the drive thereof; and a monochrome head drive unit which selects one waveform from the group of monochrome drive waveforms, based on the monochrome data, the monochrome head drive unit supplying the selected one waveform to the piezoelectric element of the monochrome head for the drive thereof; and wherein if color data and monochrome data are intermingled in the printing data for a single scanning of the head carrier, the control unit selects the color head drive waveform in response to the color data during the single scanning, and selects the monochrome waveform drive signal in response to the monochrome data, to thereby provide a switching between the color printing mode and the monochrome printing mode.

3. The ink jet printer according to claim 2, wherein a basic drive frequency of a group of color drive waveforms generated by the color drive waveform generation unit is equal to a basic drive frequency of a group of monochrome drive waveforms generated by the monochrome drive waveform generation unit.

4. The ink jet printer according to claim 3, wherein at least one intensity waveform of the group of the monochrome drive waveforms is a drive waveform that allows ink particles to be injected twice or more during a single injection cycle of the group of the color drive waveforms.

5. The ink jet printer according to claim 3, wherein the color data supplied to the color head drive unit, and the monochrome data supplied to the monochrome head drive unit are a set of pixel data containing a plurality of bits, and wherein the bit data of color pixels contains information representing ink particle diameters by the color drive waveform, while the bit data of monochrome pixels contains information representing dot positions by the monochrome drive waveform.

6. The ink jet printer according to claim 5, wherein the color head drive unit and the monochrome head drive unit include for each piezoelectric element an analog multiplexer of multi-input/single output which inputs a plurality of drive waveforms and selects any one waveform or does not perform selection at all, depending on the pixel data bit.

7. The ink jet printer according to claim 2, wherein the color drive waveform generation unit generates at least two types of color drive waveforms for different ink particle diameters, and wherein the monochrome drive waveform generation unit generates at least two types of monochrome drive waveforms that can drive injection once or a plurality of times within a single monochrome cycle.

8. The ink jet printer according to claim 7, wherein the color drive waveform generation unit generates color drive waveforms for different ink particle diameters, such as large, medium, and small diameters.

9. The ink jet printer according to claim 7, wherein the monochrome drive waveform generation unit generates monochrome drive waveforms for all dot patterns with different positions, such as front, rear, and both front and rear positions.

10. The ink jet printer according to claim 2, wherein common head control signals, including clock, shift, etc., are supplied both to the color head drive unit and the monochrome head drive unit.

11. The ink jet printer according to claim 2, wherein the color head drive unit and the monochrome head drive unit are mounted on the head carrier.

12. The ink jet printer according to claim 2, wherein the color drive waveform generation unit and the monochrome drive waveform generation unit include a waveform memory storing the group of drive waveform data, and an AD conversion unit which converts the group of drive waveform data simultaneously read out of the waveform memory, into analog waveforms.

13. The ink jet printer according to claim 1, wherein the color printing mode of the control unit is a multivalued intensity mode, and wherein the monochrome printing mode of the control unit is a high-resolution mode in which the resolution of the monochrome head is integer times the resolution of the color head.

14. The ink jet printer according to claim 13, wherein in the multivalued intensity mode of the control unit, the amount of ink particles of the color head is variable for each nozzle.

15. The ink jet printer according to claim 13, wherein in the high resolution mode of the control unit, the resolution in the horizontal scanning direction of the monochrome head is integer times the resolution of the color head.

16. The ink jet printer according to claim 13, wherein in the high resolution mode of the control unit, the ink injection cycle of the monochrome head is integer times the ink injection cycle of the color head.

17. The ink jet printer according to claim 13, wherein in the high resolution mode of the control unit, a multiple of the ink injection cycle of the monochrome head relative to the ink injection cycle of the color head is equal to a multiple of the resolution in the vertical scanning direction of the monochrome head relative to the resolution in the vertical scanning direction of the color head.

18. The ink jet printer according to claim 13, wherein in the high resolution mode of the control unit, the resolution in the vertical scanning direction of the monochrome head is integer times the resolution in the vertical scanning direction of the color head.

19. The ink jet printer according to claim 13, wherein in the high resolution mode of the control unit, the number of nozzle lines of the monochrome head is integer times the number of nozzles lines for each color of the color head.

20. The ink jet printer according to claim 13, wherein in the high resolution mode of the control unit, a multiple of the number of nozzle lines of the monochrome head relative to the number of nozzle lines for each color of the color head is equal to a multiple of the resolution of the monochrome head relative to the resolution of the color head in the horizontal scanning direction.

21. An ink jet printer comprising:

a color head having a plurality of nozzles arranged on a head carrier, each of the plurality of nozzles injecting color ink particles by the drive of a piezoelectric element; and a monochrome head having a plurality of nozzles arranged the head carrier, each of the plurality of nozzles injecting monochrome ink particles by the drive of a piezoelectric element; wherein the ink jet printer comprises a control unit which, within a single scanning of the head carrier, switches the printing mode between a color printing mode by the color head and a monochrome printing mode by the monochrome head, to thereby provide a control of printing, wherein when color data and monochrome data are intermingled, said control unit prepares color data for a single scanning operation including efficient data, corresponding to colored portions and inefficient data corresponding in non-colored portions, as well as monochrome data for a single scanning operation, including efficient data corresponding to monochrome portions and inefficient data corresponding to non-monochrome portions, wherein said control unit creates a color drive signal and a monochrome drive signal at the same time and in parallel in synchronism, with the scanning operation of the head carrier, wherein said control unit selects the color drive waveform signal to drive the color head when the color data is efficient data, but does not select the color drive signal to stop the drive of the color head when the color data are inefficient data, wherein said control unit selects the monochrome drive waveform signal to drive the monochrome head when the monochrome data is efficient data, but does not select the monochrome drive signal to stop the drive of the monochrome head when the monochrome data is inefficient data.

* * * * *